US009166332B2

(12) United States Patent
Matoba et al.

(10) Patent No.: US 9,166,332 B2
(45) Date of Patent: Oct. 20, 2015

(54) CONNECTOR

(71) Applicant: OMRON CORPORATION, Kyoto-shi, Kyoto (JP)

(72) Inventors: Masato Matoba, Kawasaki (JP); Seiji Shimada, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/831,388

(22) Filed: Mar. 14, 2013

(65) Prior Publication Data

US 2013/0288511 A1 Oct. 31, 2013

(30) Foreign Application Priority Data

Mar. 15, 2012 (JP) ..... 2012-059337

(51) Int. Cl.

| | |
|---|---|
| ***H01R 13/62*** | (2006.01) |
| ***H01R 13/627*** | (2006.01) |
| ***H01R 12/88*** | (2011.01) |
| *H01R 12/72* | (2011.01) |

(52) U.S. Cl.

CPC ..... *H01R 13/6275* (2013.01); *H01R 12/88* (2013.01); *H01R 12/721* (2013.01)

(58) Field of Classification Search

CPC ..... H01R 12/88
USPC ..... 439/495, 260, 493
See application file for complete search history.

(56) References Cited

U.S. PATENT DOCUMENTS

| | | | | |
|---|---|---|---|---|
| 6,851,968 | B2 * | 2/2005 | Tsunematsu | 439/495 |
| 6,997,729 | B2 * | 2/2006 | Sunaga | 439/260 |
| 7,112,079 | B2 * | 9/2006 | Miura et al. | 439/260 |
| 7,147,498 | B1 * | 12/2006 | Gillespie et al. | 439/260 |
| 7,172,446 | B1 * | 2/2007 | Hashimoto et al. | 439/260 |
| 7,255,584 | B2 * | 8/2007 | Takashita | 439/260 |
| 7,341,477 | B2 * | 3/2008 | Kato | 439/495 |
| 7,416,438 | B2 * | 8/2008 | Hashiguchi et al. | 439/495 |
| 7,530,831 | B2 * | 5/2009 | Nishimatsu et al. | 439/260 |
| 7,540,764 | B2 * | 6/2009 | Suzuki et al. | 439/495 |
| 7,553,183 | B2 * | 6/2009 | Taketomi et al. | 439/495 |
| 7,601,017 | B2 * | 10/2009 | Wang et al. | 439/260 |
| 7,604,499 | B2 * | 10/2009 | Sunaga | 439/495 |
| 7,614,898 | B2 * | 11/2009 | Lee et al. | 439/260 |
| 7,621,768 | B2 * | 11/2009 | Suzuki et al. | 439/260 |
| 7,632,136 | B2 * | 12/2009 | Hemmi et al. | 439/495 |

(Continued)

FOREIGN PATENT DOCUMENTS

| | | |
|---|---|---|
| CN | 101057372 A | 11/2005 |
| CN | 102290679 A | 12/2011 |

(Continued)

*Primary Examiner* — Ross Gushi

(74) *Attorney, Agent, or Firm* — Klarquist Sparkman, LLP

(57) ABSTRACT

The present invention provides a connector that has a function of enabling and facilitating a secure connection of an inserted substrate. A connector includes a housing, a contact point member, and a position determining member. The housing includes an insertion recessed portion into which a substrate is inserted. The contact point member includes a contact point portion connected electrically to a conductive portion of the substrate. The position determining member determines a position of the contact point member. The position is determined to connect the contact point portion to the conductive portion of the substrate and is driven by moving the contact point member to retract the contact point portion from the insertion recessed portion and inserting the substrate into the insertion recessed portion.

8 Claims, 17 Drawing Sheets

(56) References Cited

U.S. PATENT DOCUMENTS

| | | | | |
|---|---|---|---|---|
| 7,637,763 | B1 * | 12/2009 | Peng | 439/260 |
| 7,648,386 | B2 * | 1/2010 | Suzuki et al. | 439/495 |
| 7,677,917 | B2 * | 3/2010 | Hemmi et al. | 439/495 |
| 7,713,078 | B2 * | 5/2010 | Nishimatsu et al. | 439/260 |
| 7,766,680 | B2 * | 8/2010 | Suzuki et al. | 439/260 |
| 7,789,698 | B2 * | 9/2010 | Hashimoto et al. | 439/495 |
| 7,837,489 | B2 * | 11/2010 | Kameda | 439/260 |
| 7,862,358 | B2 * | 1/2011 | Nishimatsu et al. | 439/260 |
| 7,862,370 | B1 * | 1/2011 | Chen | 439/495 |
| 7,896,675 | B2 * | 3/2011 | Hemmi et al. | 439/260 |
| 7,901,232 | B2 * | 3/2011 | Kodaira | 439/260 |
| 8,128,425 | B2 * | 3/2012 | Takahashi et al. | 439/260 |
| 8,128,429 | B2 * | 3/2012 | Suzuki | 439/493 |
| 8,177,570 | B2 * | 5/2012 | Tanaka et al. | 439/259 |
| 8,182,277 | B2 * | 5/2012 | Yokoo et al. | 439/260 |
| 8,192,215 | B2 * | 6/2012 | Lin et al. | 439/260 |
| 8,267,709 | B2 * | 9/2012 | Taketomi | 439/329 |
| 8,337,226 | B2 * | 12/2012 | Yokoo | 439/260 |
| 8,382,504 | B2 * | 2/2013 | Matoba et al. | 439/350 |
| 8,579,654 | B2 * | 11/2013 | Chen et al. | 439/495 |
| 8,613,631 | B2 * | 12/2013 | Hemmi et al. | 439/495 |
| 8,641,439 | B2 * | 2/2014 | Tateishi et al. | 439/260 |
| 8,672,698 | B2 * | 3/2014 | Sasaki et al. | 439/260 |
| 8,827,732 | B2 * | 9/2014 | Lin et al. | 439/260 |
| 2002/0106924 | A1 * | 8/2002 | Uehara | 439/260 |
| 2002/0137383 | A1 * | 9/2002 | Tsunematsu | 439/260 |
| 2002/0137384 | A1 * | 9/2002 | Tsunematsu | 439/260 |
| 2002/0151211 | A1 * | 10/2002 | Takashita et al. | 439/495 |
| 2003/0060072 | A1 * | 3/2003 | Miura | 439/260 |
| 2003/0092310 | A1 * | 5/2003 | Kunishi et al. | 439/495 |
| 2003/0157829 | A1 * | 8/2003 | Kunishi et al. | 439/495 |
| 2004/0002254 | A1 * | 1/2004 | Tsunematsu | 439/495 |
| 2004/0266242 | A1 * | 12/2004 | Shiu et al. | 439/260 |
| 2005/0026487 | A1 * | 2/2005 | Yu | 439/260 |
| 2005/0255732 | A1 * | 11/2005 | Sunaga | 439/260 |
| 2006/0084311 | A1 * | 4/2006 | Suzuki et al. | 439/260 |
| 2006/0089045 | A1 * | 4/2006 | Miura et al. | 439/495 |
| 2006/0105622 | A1 * | 5/2006 | Nakano et al. | 439/495 |
| 2006/0121776 | A1 * | 6/2006 | Kao | 439/495 |
| 2006/0172590 | A1 * | 8/2006 | Yamada et al. | 439/495 |
| 2006/0199410 | A1 * | 9/2006 | Chen | 439/260 |
| 2007/0032115 | A1 * | 2/2007 | Takashita | 439/260 |
| 2007/0049087 | A1 * | 3/2007 | Hashimoto et al. | 439/260 |
| 2007/0066127 | A1 * | 3/2007 | Inoue | 439/495 |
| 2007/0093122 | A1 * | 4/2007 | Kudo et al. | 439/495 |
| 2007/0117451 | A1 * | 5/2007 | Yokoyama | 439/495 |
| 2007/0134975 | A1 * | 6/2007 | Shin | 439/495 |
| 2007/0141897 | A1 * | 6/2007 | Miura et al. | 439/495 |
| 2007/0202736 | A1 * | 8/2007 | Takashita | 439/495 |
| 2008/0050966 | A1 * | 2/2008 | Hashiguchi et al. | 439/495 |
| 2008/0064255 | A1 * | 3/2008 | Suzuki et al. | 439/493 |
| 2008/0113542 | A1 * | 5/2008 | Sunaga | 439/260 |
| 2008/0233781 | A1 * | 9/2008 | Matoba et al. | 439/258 |
| 2008/0254662 | A1 * | 10/2008 | Koga | 439/260 |
| 2009/0130881 | A1 * | 5/2009 | Suzuki et al. | 439/260 |
| 2009/0298315 | A1 * | 12/2009 | Iida et al. | 439/259 |
| 2010/0130044 | A1 * | 5/2010 | Taketomi | 439/260 |
| 2010/0144184 | A1 * | 6/2010 | Nishimatsu et al. | 439/260 |
| 2010/0151716 | A1 * | 6/2010 | Suzuki et al. | 439/260 |
| 2011/0104938 | A1 * | 5/2011 | Suzuki | 439/493 |
| 2011/0312202 | A1 * | 12/2011 | Matoba et al. | 439/329 |
| 2011/0312205 | A1 * | 12/2011 | Matoba et al. | 439/350 |
| 2012/0268137 | A1 * | 10/2012 | Takamori et al. | 324/538 |
| 2013/0023138 | A1 * | 1/2013 | Sasaki et al. | 439/260 |
| 2013/0280947 | A1 * | 10/2013 | Matoba et al. | 439/372 |
| 2013/0309887 | A1 * | 11/2013 | Honda | 439/260 |

FOREIGN PATENT DOCUMENTS

| | | |
|---|---|---|
| JP | 2005-332706 A | 12/2005 |
| JP | 2008-210734 A | 9/2008 |
| KR | 10-0798758 | 1/2008 |

* cited by examiner

CONNECTOR

BACKGROUND OF THE INVENTION

1. Technical Field

The present invention relates to a connector.

2. Related Art

Conventionally, there is a known connector which enables a connection with a terminal with only insertion of a flat conductor (a substrate) (for example, Japanese Unexamined Patent Publication No. 2008-210734).

However, in the conventional connector, an internal structure including a cooperation arm and a contact arm, which are elastically deformable, is provided in each of a plurality of terminals arranged in parallel. In addition, the inserted flat conductor is held by a contact portion and a pressed portion formed in the internal structure and the contact portion is made conductive. For this reason, in the case where the housing with the terminals arranged therein is curved in a bow shape by an external force, the inserted conductor is not likely to be surely made conductive in all the terminals because the positions of the cooperation arm and the contact arm, adjacent to each other, are shifted. Furthermore, there is a problem that it cannot be easily determined with the eyes whether or not the flat conductor is made conductive.

SUMMARY

The present invention has been devised to solve the problems described above, and an object thereof is to provide a connector that has a function of enabling and facilitating a secure connection of an inserted substrate, and a function of enabling easy recognition on whether or not the inserted substrate is in a state of being properly and electrically connected from the outside, without needing too many items of equipment.

In accordance with one aspect of the present invention, there is provided a connector including a housing with an insertion recessed portion into which a substrate is to be inserted, a contact point member that is installed in the housing and includes a contact point portion which protrudes inside the insertion recessed portion and makes an electrical connection to a conductive portion of the substrate to be inserted, and a position determining member that moves the contact point member in a manner to retract the contact point portion from the insertion recessed portion and in a manner to cause the contact point portion, which is driven by the substrate being inserted into the insertion recessed portion in the housing, to protrude inside the insertion recessed portion and to come into contact with the conductive portion of the inserted substrate.

With this configuration, the connection between the conductive portion of the substrate and the contact point portion of the contact point member may be easily made, and moreover the number of operational works may be reduced. Furthermore, the insertion of the substrate to a proper position alone automatically completes the connection. For this reason, regardless of operator, variations in the connection state are not likely to occur, and the connection may be certainly made.

The position determining member is preferably moved depending on each movement in such a manner that the movement of the position determining member is recognizable from the outside of the housing.

With this configuration, when the substrate is inserted into the insertion recessed portion of the housing, the position determining member causes the conductive portion of the substrate and the contact point portion of the contact point member to come into contact with each other, and the movement thereof may be recognizable from the outside. Therefore, the user may determine whether or not a proper electrical connection is made by the movement of the position determining member.

The position determining member may include a movement member that is movable between a first position where the movement member retracts the contact point portion of the contact point member from the insertion recessed portion, and a second position where the movement member causes the contact point portion of the contact point member to protrude inside the insertion recessed portion, and a latching member that is able to position-determine the movement member in the first position and that is moved by the substrate being inserted into the insertion recessed portion in the housing, thereby canceling the position-determined state.

With this configuration, the position determining member may be made to function by only two members. That is, when the substrate is inserted into the insertion recessed portion, the position-determined state in which the movement member is position-determined in the first position is canceled and the movement member moves to the second position. Therefore, the electric connection state of the substrate and the contact member can be checked only by seeing a motion of the position-determining member.

In the first position of the movement member, the movement member preferably protrudes from the housing and the first position is preferably distinguishable from the second position.

It is to be noted that the elastic holding be meant also to include a function of holding while increasing an elastic force at the time of installing, without having to exert an elastic force on the shaft portion in a state of being installed in the housing.

With this configuration, it may be easily determined from the movement of the movement member, that is, from the first position where the movement member protrudes from the housing, that the substrate is set to the proper position, based on the fact that the movement member is moved to the second position where the movement member does not protrude.

The movement member preferably includes a shaft portion, and the contact point member preferably includes a holding portion that elastically holds the shaft portion of the movement member in a state of being installed in the housing.

With this configuration, not only a separate member for holding the movement member is made unnecessary, but also the smooth movement of the movement member may be caused by the elastic supporting.

The holding portion of the contact point member preferably urges the movement member positioned in the first position so as to be able to move to the second position.

With this configuration, only the canceling of the latched state by the latching member may automatically move the movement member that is positioned-determined in the first position to the second position, by the elastic force exerted by the holding portion of the contact point member.

The movement member may be supported by the holding portion of the contact point member in such a manner as to rotate about the shaft portion, and the movement of the movement member from the first position to the second position may be caused by the rotation about the shaft portion.

The latching member may include a pressure receiving portion that is pressed by a leading end edge of the substrate inserted into the insertion recessed portion in the housing, an elastic member that is elastically deformed by the pressure receiving portion being pressed, and an arm portion that has a latch protrusion member and that is separated from the movement member by the elastic member being elastically deformed, and the movement member may include a first latch recessed portion onto which a latch protrusion portion formed in the arm portion is able to be latched when the movement member is in the first position, and a second latch recessed portion onto which the latch protrusion portion formed in the arm portion is able to be latched when the movement member is in the second position.

The position determining member preferably includes a movement sound generating mechanism that generates movement sound when the position determining member is moved by the substrate being inserted into the insertion recessed portion in the housing and the position-determined state is canceled.

With this configuration, the state of the electrical connection between the substrate and the contact point member may be checked not only through a sense of sight, but also through a sense of hearing.

According to the present invention, only the insertion of the substrate into the insertion recessed portion in the housing may automatically complete the electrical connection between the substrate and the contact point member, without the need for the user to operate the movement member. For this reason, an operation of assembling the substrate may be made easy and the number of operational works may be reduced. Furthermore, since the definite electrical connection is made easy, and the position determining member moving the contact point portion is provided in such a manner as to be recognizable from the outside of the housing after the completion of the connection operation, the state of the electrical connection between the substrate and the contact point portion in the insertion recessed portion may be checked in a simple manner.

DETAILED DESCRIPTION

Embodiments according to the present invention are described below referring to the accompanying drawings. It is to be noted that the terms (for example, terms including "upward," "downward," "sideways," and "end.") expressing specific directions and positions be used if necessary in the following description, but these terms be used only for an easy understanding of the present invention that is described with reference to the drawings and the meanings of these terms not limit a technical scope of the present invention.

Furthermore, the following description is only an example in nature, and is not intended to limit the present invention, applications thereof, or uses thereof.

First Embodiment

Figure 1:
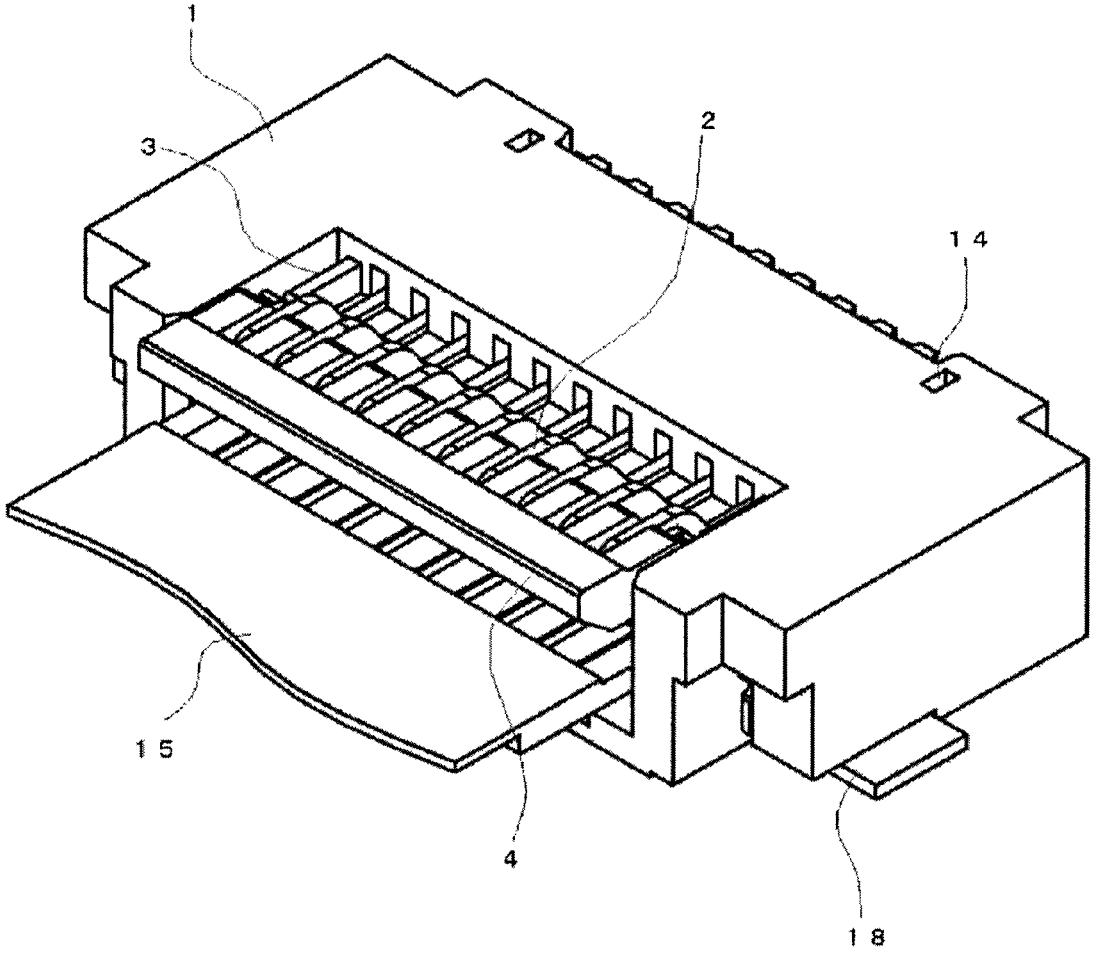
FIG. 1 is a perspective view illustrating a state in which a substrate is installed in a connector according to a first embodiment.
Figure 2:
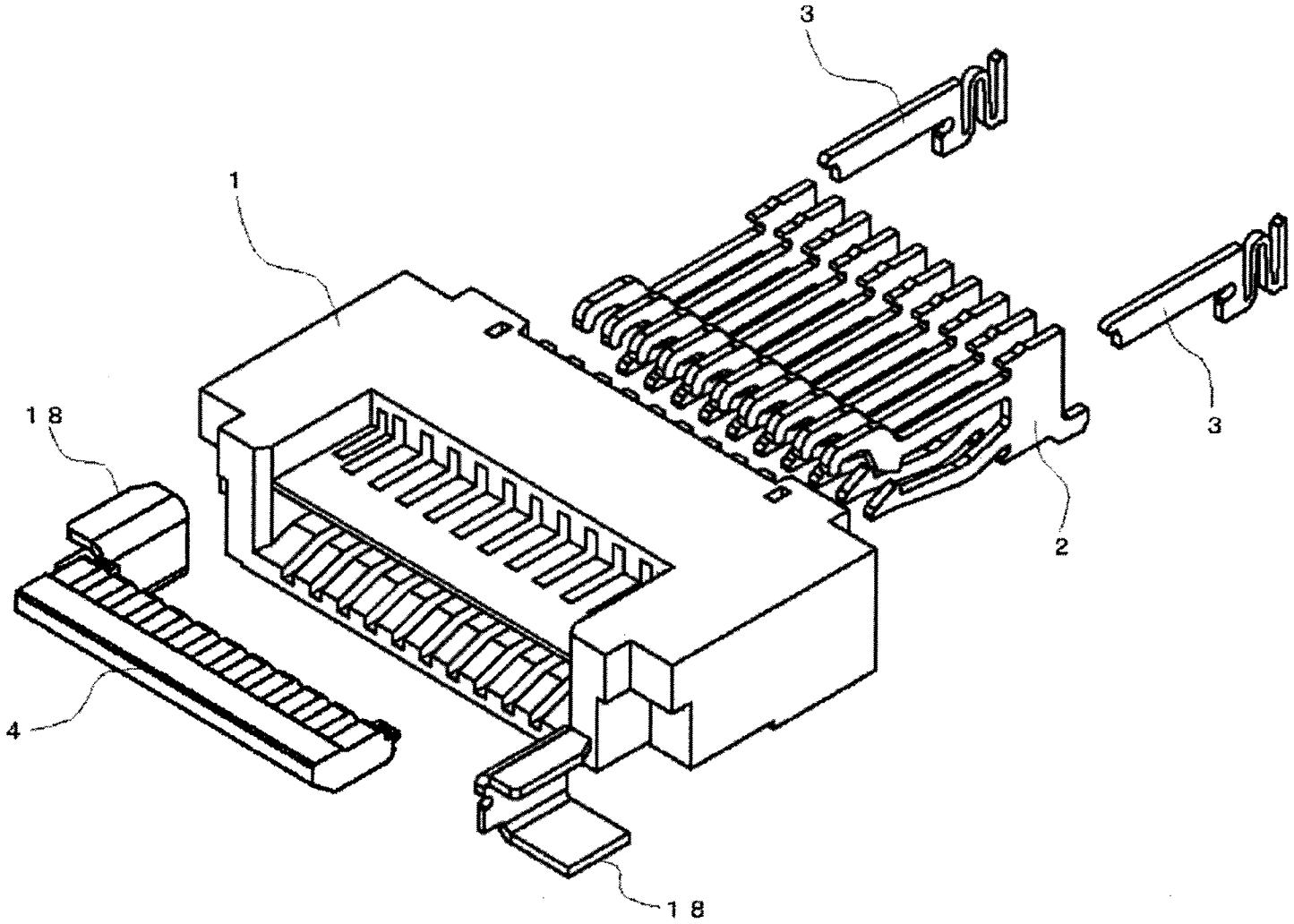
FIG. 2 is a perspective exploded view illustrating the connector in FIG. 1.

FIG. 1 is an overall view illustrating a connector according to a first embodiment, and FIG. 2 is a perspective exploded view illustrating the connector. The connector is configured by mounting a contact point member 2, a latching member 3, and a movement member 4 to a housing 1.

Figure 3A:
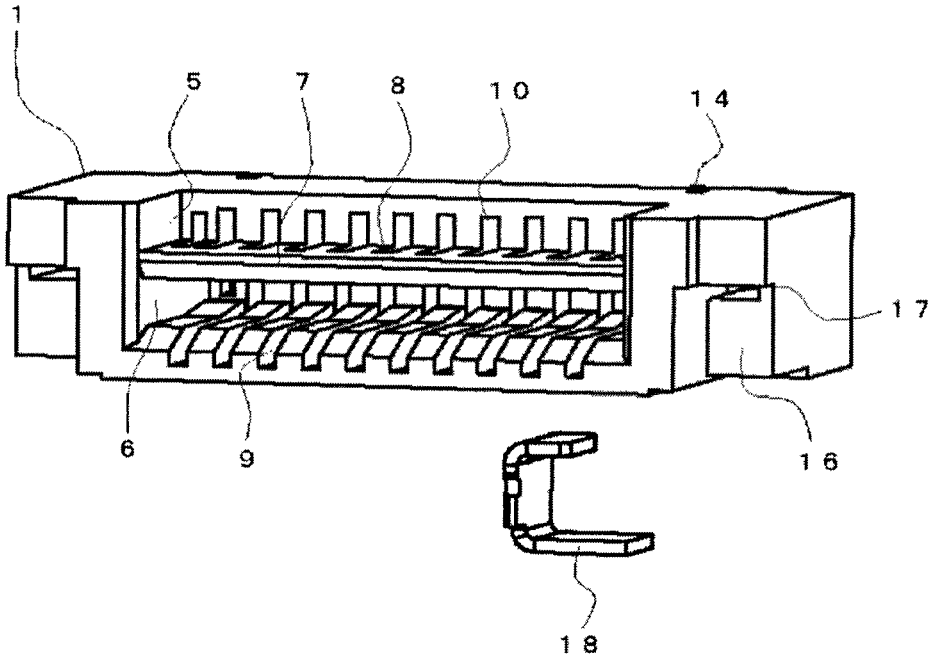
FIG. 3A is a perspective view illustrating a housing in FIG. 2 and one fixation fitting.
Figure 3B:
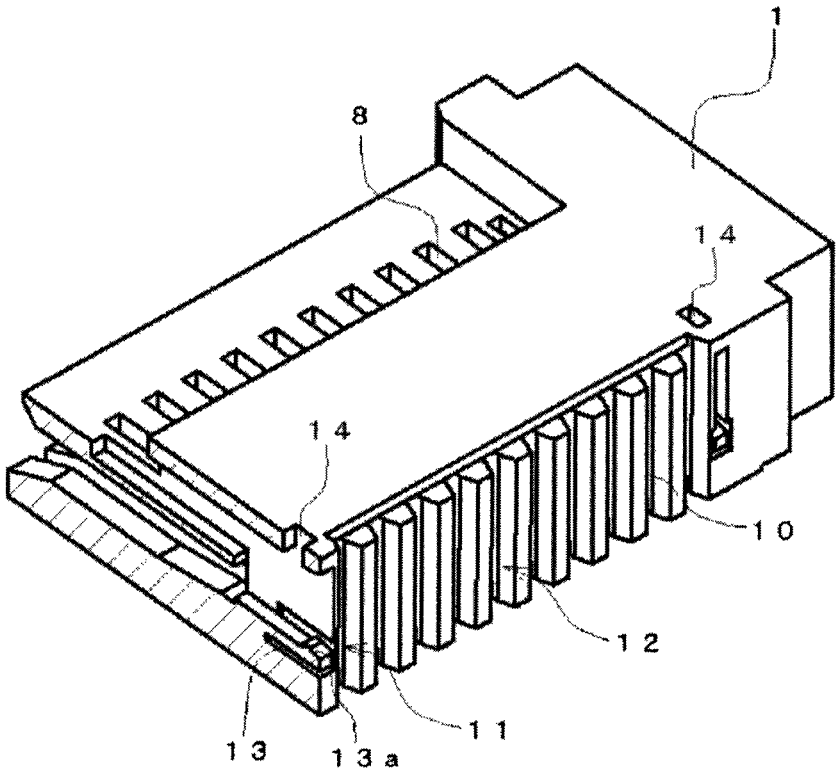
FIG. 3B is a perspective view of the housing in FIG. 2 which is partially cut away.
Figure 4:
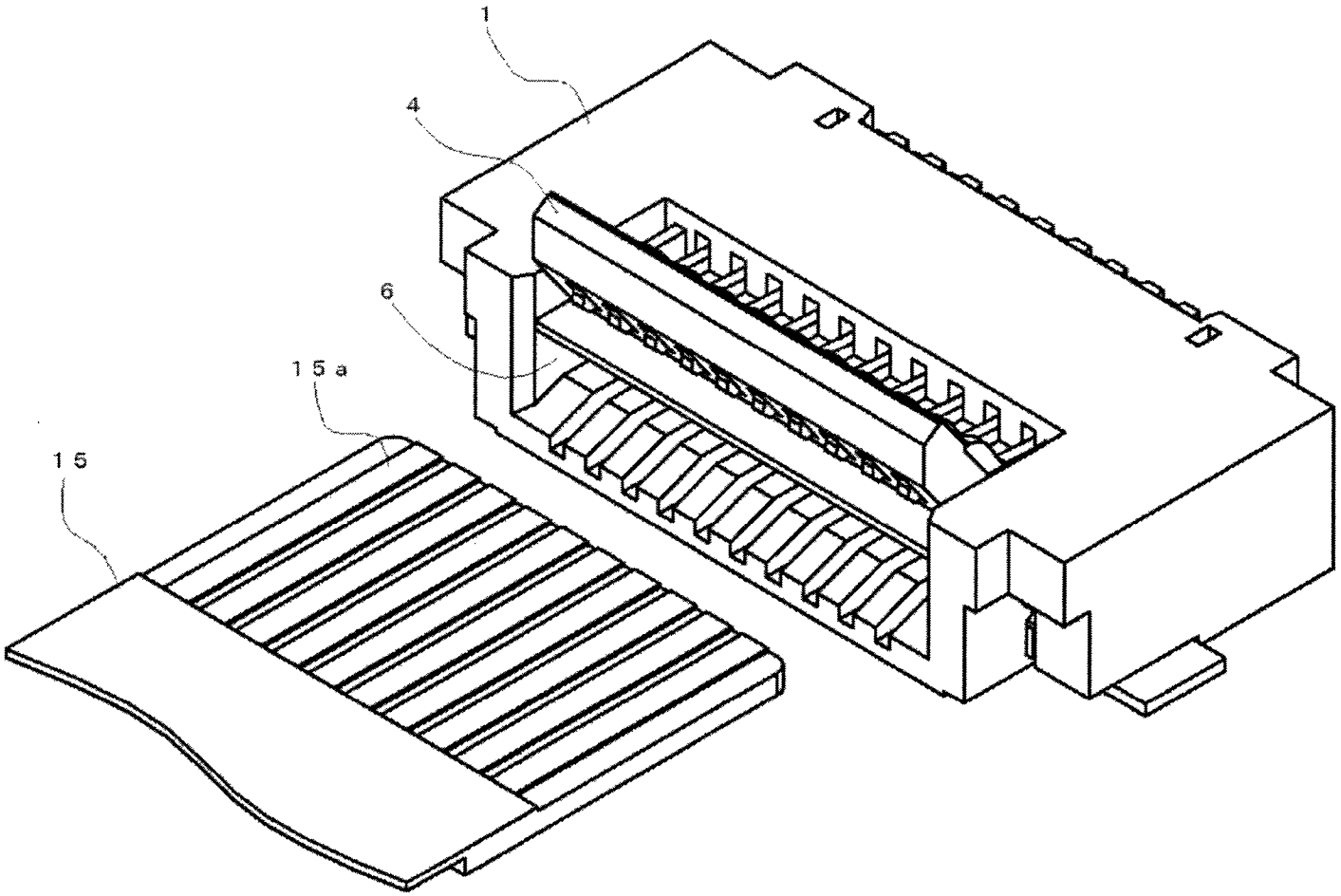
FIG. 4 is a perspective view illustrating a state of the substrate and the connector before the substrate is installed in the connector according to the first embodiment.

As illustrated in FIGS. 3A and 3B, the housing 1 is a product manufactured by molding resin material having electrical insulation into the approximately rectangular parallelepiped shape. The housing 1 has a recess 5 and which is open at the upper surface side and the front surface side, and an insertion recessed portion 6 which is provided under the recess 5 and is open at the front surface side. The recess 5 and the insertion recessed portion 6 are separated by a partition wall 7.

A plurality of guide holes 8 are formed in the partition wall 7, at predetermined intervals in the width direction. The plurality of guide holes 8 are formed to communicate with the upper and lower surfaces and extend in the backward direction. Furthermore, guide groove portions 9 are formed in the bottom surface which makes up the insertion recessed portion 6. The guide groove portions 9 are formed to correspond to the guide holes 8 and extend in the forward and backward directions. The guide holes 8 and the guide groove portions 9 communicate with insertion holes 10 in the rear surface side of the housing 1. The insertion holes 10 are open in the direction of the rear surfaces of the recessed hole 5 and the insertion recessed portion 6 and in the direction of the rear surface of the housing 1. The guide holes 8, the guide groove portions 9, and the insertion holes 10 positioned at both side ends, make up a first attachment portion 11 for installing the latching member 3. The plurality of insertion holes 10, arranged in parallel between the insertion holes 10, make up a second attachment portion 12 for installing the contact point member 2. In each of the first attachment portions 11, a latching portion 13, which has a latching pawl 13*a* protruding upward from a leading end portion, is formed in a bottom surface trailing end portion making the first attachment portion 11, in such a manner as to be elastically deformable downward. A latching hole 14 in the rectangular shape, which communicates with the first attachment portion 11, is formed in a position corresponding to the latching portion 13, in an upper wall making up the insertion hole 10.

The front end lower surface of the partition wall 7 is an upward-inclined surface that is gradually inclined upward, along the direction of facing toward the front direction. Furthermore, the bottom surface front end part of the insertion recessed portion 6 is a downward-inclined surface that is gradually inclined downward, along the direction of facing toward the front direction. Furthermore, the inside surface front end part of each of both side walls is a sideways-inclined surface that is gradually inclined from side to side, along the direction of facing toward the front direction. These inclined surfaces are for facilitating an insertion of a substrate 15 (refer to FIG. 1) into the insertion recessed portion 6. At this point, an FPC (Flexible Printed Circuit) substrate is used as the substrate 15.

A release recessed portion 16 is formed in each of both end portions of the front surface of the housing 1, and an approximately L-shaped groove portion 17 being open in the direction of the front surface is formed in the release recessed portion 16. A fixation fitting 18 is fixed by being pressed into each groove portion 17 from the front side. The fixation fitting 18 is a metal plate bent in the shape of a letter approximately like "C". In the fixation fitting 18, the upper end wall and the side wall are pressed into the groove portion 17, the lower end wall is narrow in width, and the lower surface side protrudes from the lower surface of the housing 1.

Figure 5:
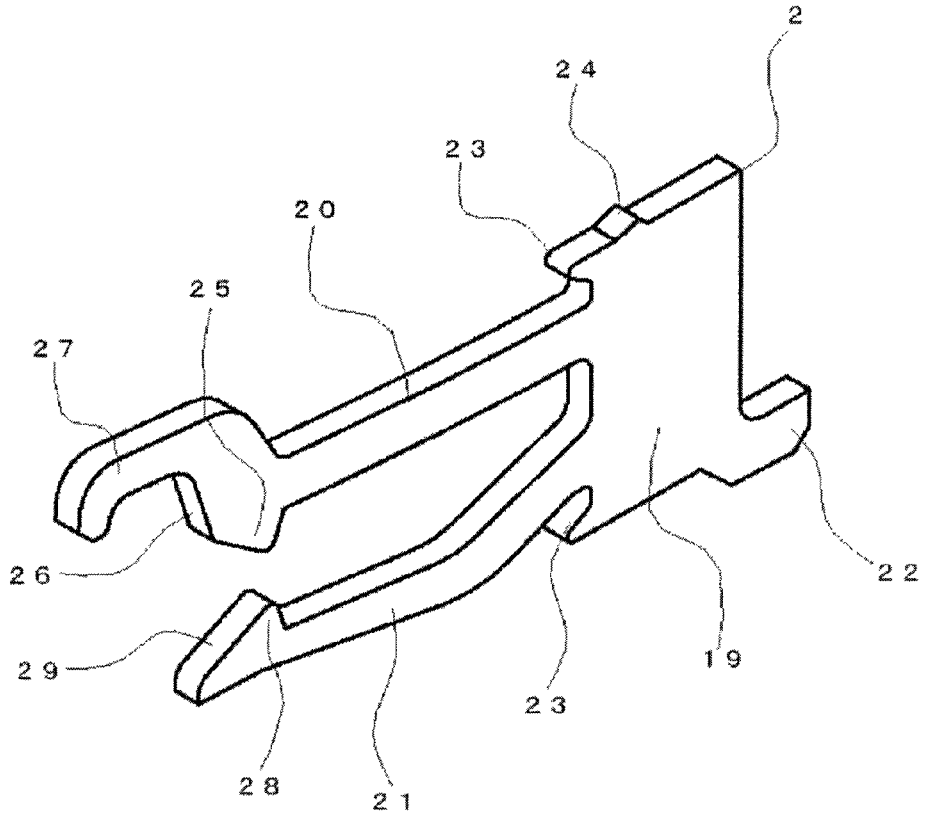
FIG. 5 is a perspective view illustrating a contact point member in FIG. 2.

As illustrated in FIG. 5, the contact point member 2 includes an installation portion 19, installed in the insertion hole 10, a first arm portion 20 and a second arm portion 21 that extend forward from the upper and lower parts of the front end edge of the installation portion 19, respectively, and a terminal portion 22 that extends from the lower part of the rear end. The contact point member 2 is formed by performing process working on a conductive and elastic plate. The contact point members 2 are installed in the second attachment portions 12, respectively that are installed in parallel in the housing 1.

Protrusion portions 23 are formed in an upward position in the first arm portion 20 and a downward position in the second arm portion 21, respectively in the front end edge of the installation portion 19. Furthermore, a press-in protrusion portion 24, which protrudes upward in the vicinity of the protrusion portion in the upward position, is formed in the upper end edge of the installation portion 19.

The first arm portion 20 protrudes forward from installation portion 19, and a contact point portion 25 is formed in a manner to protrude downward from the leading end part of the first arm portion 20. The downward side of the leading end edge of the contact point portion 25 has an inclination portion 26 that gradually faces upward, along the direction of the leading end. A holding piece 27 is formed in the leading part of the contact point portion 25. The holding piece 27 extends upward in the shape of a letter approximately C. The holding piece 27 is in the form that conforms the upper half of a shaft portion 39 of the movement member 4 described below. The holding piece 27 holds the shaft portion 39 to support the movement member 4 in a manner that the movement member 4 is rotatable.

The second arm portion 21 obliquely extends downward and thereafter protrudes from the installation portion 19 in parallel with the first arm portion 20. A protrusion portion 28, which protrudes upward from the leading end part of the second arm portion 21, is formed in a position facing the contact point portion 25 of the first arm portion 20. An inclination portion 29 is formed on the upper side of the leading end edge portion of the protrusion portion 28. The inclination portion 29 faces the inclination portion 26 of the first arm portion 20.

Figure 6:
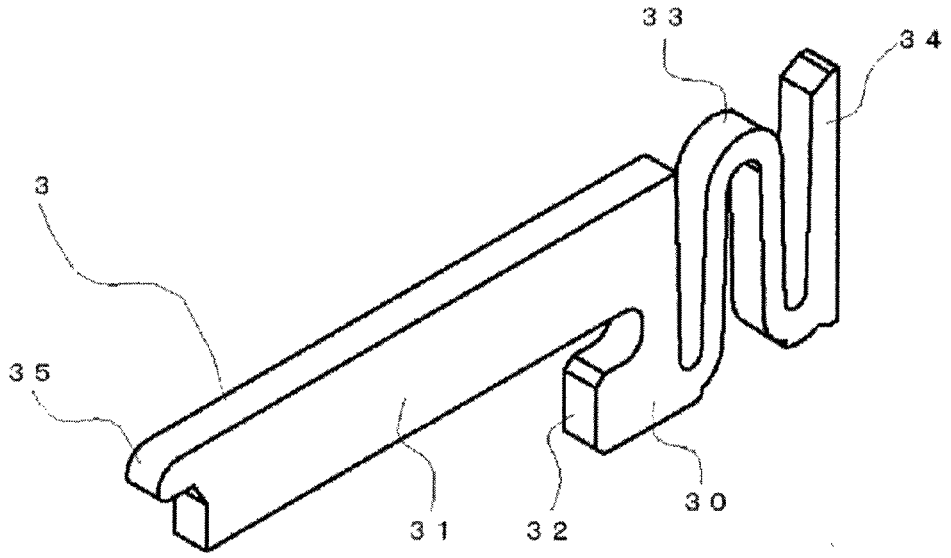
FIG. 6 is a perspective view illustrating a latching member in FIG. 2.

As illustrated in FIG. 6, the latching member 3 includes an installation portion 30, installed in the insertion hole 10, and an arm portion 31, which extends forward from the upper part of the front end edge of the installation portion 30. The latching member 3 is obtained by performing press working on metal material, or by performing a molding process using synthetic resin. The two latching members 3 are installed in the first attachment portions 11 positioned on both sides of the second attachment portions 12 that are installed in parallel, respectively. A pressure receiving portion 32, which protrudes forward, is formed on the lower side of the front end edge of the installation portion 30. The pressure receiving portion is pressed by the substrate 15 inserted into the insertion recessed portion 6 of the housing 1. An elastic portion 33, which winds in the shape of a letter approximately U, and a stopping portion 34 in succession to the elastic portion 33 are formed to extend from the rear end edge of the installation portion 30. The elastic portion 33 elastically deforms as the front end edge of the installation portion 30 is pressed by the substrate 15 inserted into the insertion recessed portion 6 as illustrated below. The stopping portion 34 elastically deforms the latching portion 13 formed in the first attachment portion 11 of the housing 1, so that the rear end upper part of the latching member is latched into the latching hole 14 of the housing 1 and the latching pawl which is on the top is latched to the rear end lower part thereof. A latch protrusion portion 35, which protrudes forward, is formed on the upper side of the front end edge of the arm portion 31.

Figure 7A:
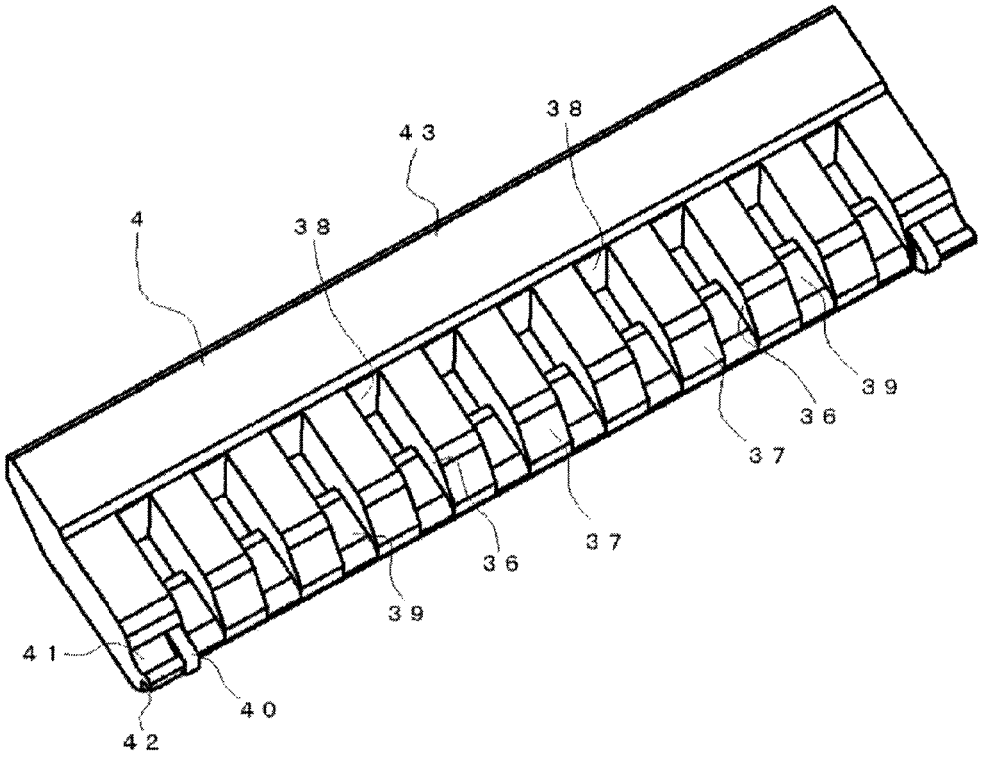
FIG. 7A is a perspective view illustrating a movement member in FIG. 2.
Figure 7B:
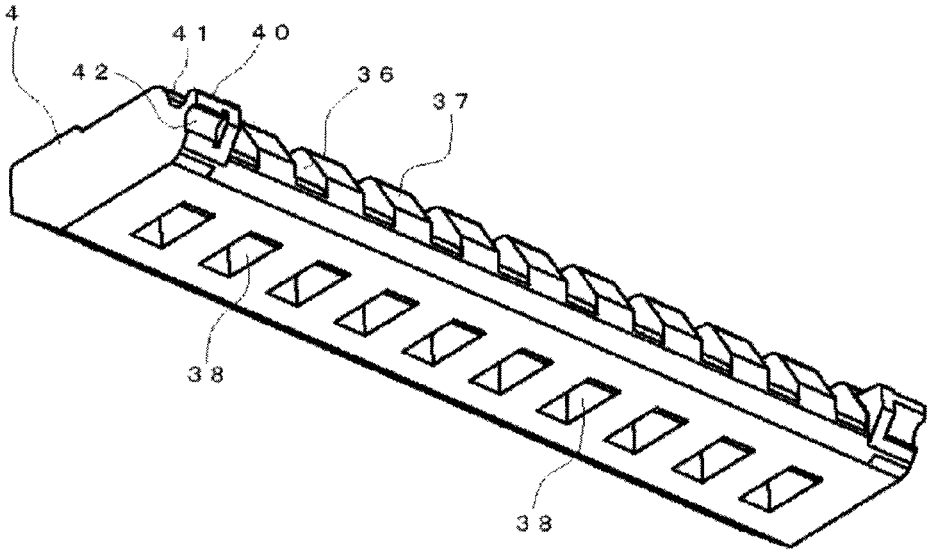
FIG. 7B is a perspective view illustrating a state of the movement member in FIG. 7A when viewed from a different angle.

As illustrated in FIGS. 7A and 7B, the movement member 4 is manufactured by performing a molding process using resin material, to be in the shape of a plate, long in length. Multiple guide walls 37 are formed in the upper surface half part of the movement member 4. The plurality of guide walls 37 are configured from a plurality of groove portions 36 that are provided at predetermined intervals in the longitudinal direction. Furthermore, the shaft portion 39 is formed between the guide walls 37, by a communication hole 38 that is provided in the bottom surface of the groove portions 36 to communicate upward and downward. The shaft portion 39 is configured from two plane surfaces, which are opposite to and in parallel with each other, and a pair of arc surfaces, which swells outward. The shaft portion 39 is supported by the holding piece 27 of the contact point member 2, and the movement member 4 is rotatably supported. A latch receiving portion 40 protrudes from each of the leading end parts of the guide wall 37 that is positioned in both end parts of the movement member 4. A first latch recessed portion 41 is formed in the upward side of the latch receiving portion 40, and a second latch recessed portion 42 is formed in the downward side. The arc surface and the plane surface are in succession to each other in the first latch recessed portion 41 and the second latch recessed portion 42. The latch protrusion portion 35, which is formed in the arm portion 31 of the latching member 3, is latched to or unlatched from each of the latch recessed portions 41 and 42. The movement member 4 is position-determined in a standing position (a first position) that protrudes from the recess 5, in a state where the latch protrusion portion 35 is latched to the first latch recessed portion 41. On the other hand, in the state in which the latch protrusion portion 35 is latched onto the second latch recessed portion 42, the movement member 4 is positioned in a horizontal position (second position) where the lower surface of the movement member 4 comes into contact with the upper surface of the recess 5, and the upper surface of the movement member 4 is flush with the upper surface of the housing 1. When the movement member 4 is positioned in the standing position, the first arm portion 20 of the contact point member 2 is elastically deformed to urge the shaft portion 39 to move downward. For this reason, when the latch protrusion portion 35 is unlatched from the first latch recessed portion 41, the urging force makes the movement member 4 return back to the horizontal position. It is to be note that the remaining half part (the side in which the guide wall 37 is not formed) of the movement member 4 serve as an operation unit 43 which is held by fingers for operation.

The connector with the configuration described above is assembled as follows.

First, the contact point members 2 are inserted into the insertion holes 10 in the second attachment portion 12 of the housing 1, respectively from the rear end side of the insertion holes 10. The contact point member 2 is installed in the housing 1, by inserting the installation portion 30 into the insertion hole 10 and bringing the press-in protrusion portion 24 into pressure contact with the inside surface of the insertion hole 10. In this mounted state, the leading end of the contact point portion 25 of the first arm portion 20 approaches the front inside surface of the guide hole 8 formed in the partition wall 7. The holding piece 27 protrudes inside the recess 5, and a gap occurs between the leading end part of the holding piece 27 and the upper surface of the partition wall 7. Furthermore, the contact point portion 25 protrudes inside the insertion recessed portion 6.

Subsequently, the movement member 4 is installed by using the holding piece 27 of the contact point member 2 protruding inside the recess 5 in the housing 1. The shaft portion 39 of the movement member 4 is inserted into the gap that is formed between the leading end portion of the holding piece 27 and the bottom surface of the recess 5, from the front side. The holding piece 27 is elastically deformed by the shaft portion 39 of the movement member 4 and then returns back to the original shape to hold the shaft portion 39. Thus, the installation of the movement member 4 is complete. In this state, the movement member 4 is positioned in the horizontal position.

Thereafter, the latching member 3 is inserted into the insertion hole 10 in the second attachment portion 12, from the rear surface side. The latching member 3 may be installed only by inserting the arm portion 31 into the insertion hole 10 and pressing the installation portion 30. In this state, the positioning is achieved in a manner that the latch protrusion portion 35 of the latching member 3 is latched to the second latch recessed portion 42 of the movement member 4 that is positioned in the horizontal position.

Figure 8A:
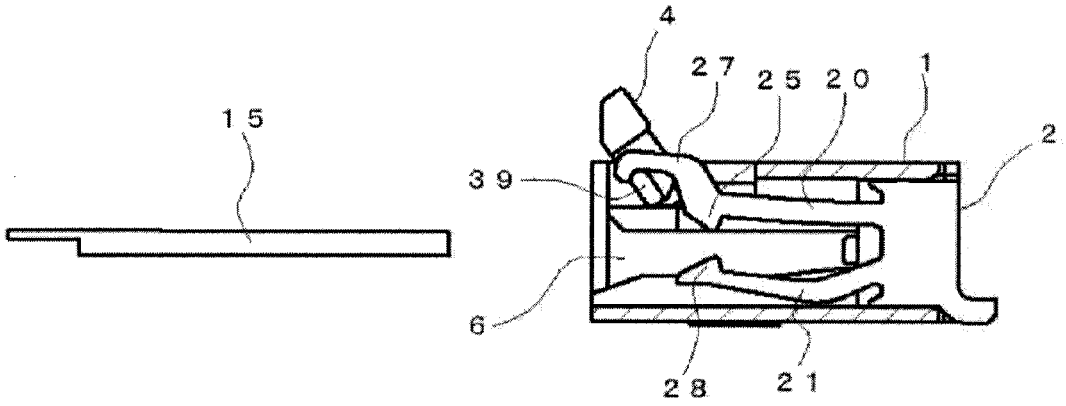
FIG. 8A is a cross-sectional view illustrating the connector and the substrate in FIG. 4 at a position from which the contact point member can be viewed.
Figure 8B:
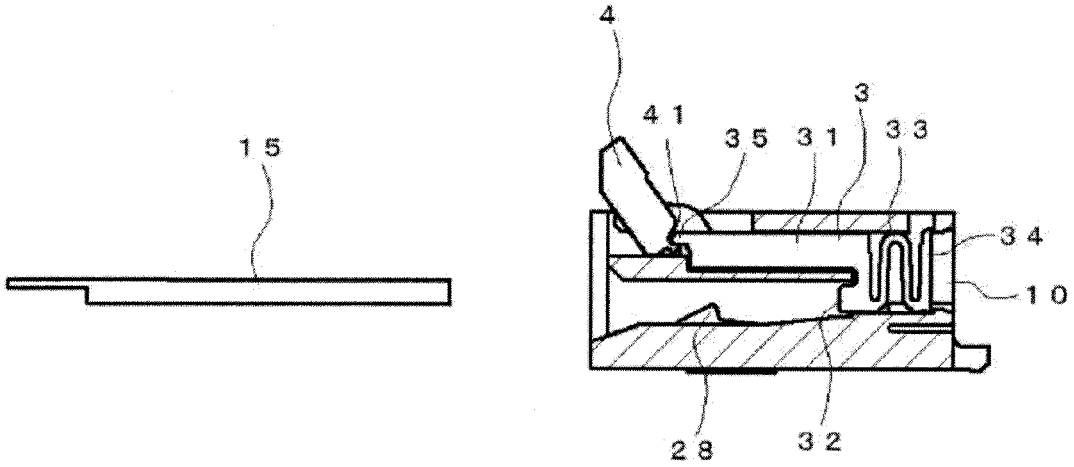
FIG. 8B is a cross-sectional view illustrating the connector and the substrate in FIG. 4 at a position from which the latching member can be viewed.

In the connector that is assembled in this manner, in the case where the substrate 15 is installed, first, the operation unit 43 of the movement member 4 is rotated by the finger-used picking and is positioned in the standing position that protrudes from the recess 5, as illustrated in FIG. 8A. At this time, as illustrated in FIG. 8B, the latch protrusion portion 35 of the latching member 3 is switched from the second latch recessed portion 42 to the first latch recessed portion 41. For this reason, the movement member 4 maintains a state of being position-determined in the standing position. Furthermore, the arm portion 31 of the latching member 3 is elastically deformed upward, and the contact point portion 25 is retracted from the insertion recessed portion 6.

Figure 9A:
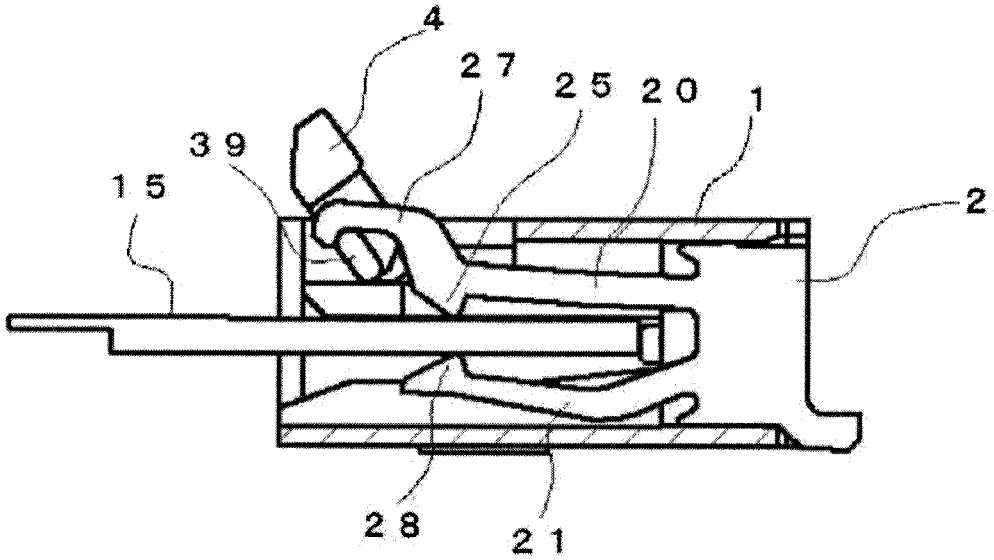
FIG. 9A is a cross-sectional view illustrating a state in which the substrate is inserted into an insertion recessed portion of the connector in FIG. 8A and a leading end edge thereof comes into contact with a pressure receiving portion of the latch member.
Figure 9B:
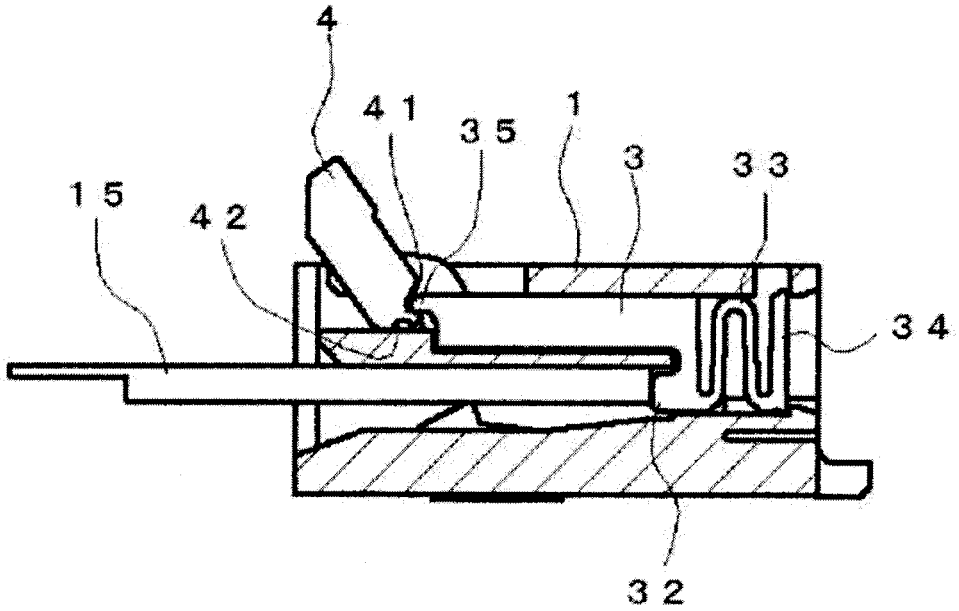
FIG. 9B is a cross-sectional view illustrating a state in which the substrate is inserted into the insertion recessed portion of the connector in FIG. 8B and the leading end edge thereof comes into contact with the pressure receiving portion of the latch member.
Figure 10A:
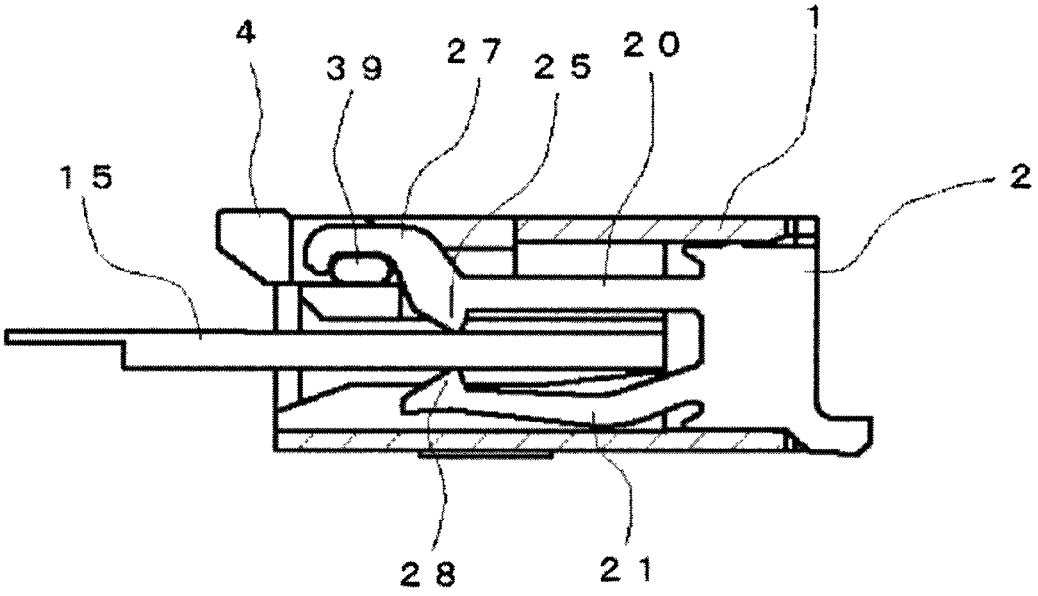
FIG. 10A is a cross-sectional view illustrating the connector and the substrate in FIG. 1 at a position from which the contact point member can be viewed.
Figure 10B:
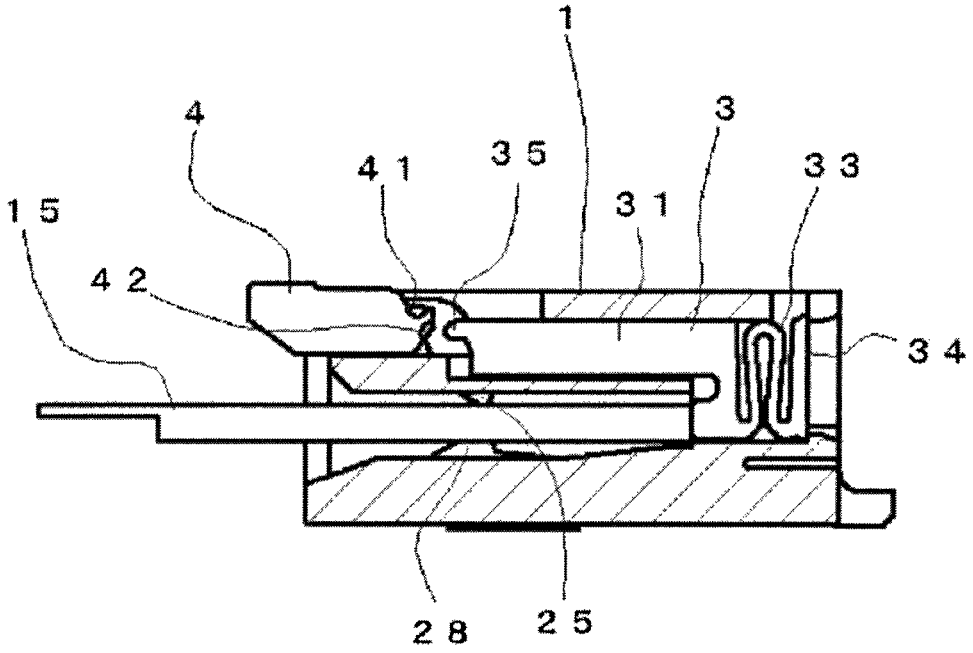
FIG. 10B is a cross-sectional view illustrating the connector and the substrate in FIG. 1 at a position from which the latching member can be viewed.

When the substrate 15 is inserted into the insertion recessed portion 6 as illustrated in FIG. 9A, the leading end edge of the substrate 15 may come into contact with the pressure receiving portion 32 of the latching member 3, and the installation portion 30 may be pushed inwards against the urging force of the elastic portion 33. Thus, the arm portion 31 extending forward from the installation portion 30 retreats, and as illustrated in FIGS. 9B to 10B, the latch protrusion portion 35 of the latching member 3 thereof is unlatched from the first latch recessed portion 41. Since an elastic force from the holding piece 27 of the contact point member 2 acts on the shaft portion 39, the movement member 4 returns to the horizontal position from the standing position depending on the elastic force, as illustrated in FIG. 10A. As a result, the contact point portion 25 of the contact point member 2 protrudes inside the insertion recessed portion 6, and comes into pressure contact with a conductive layer of the substrate 15 inserted into the insertion recessed portion 6 to make an electrical connection. Moreover, when the conductive portion 15*a* of the substrate 15 is inserted toward the lower surface side, the electrical connection between the conductive portion 15*a* and the protrusion portion 28 of the contact point member 2 may be made (in this case, the protrusion portion 28 functions as the contact point portion).

When the substrate 15 is inserted into the insertion recessed portion 6 of the housing 1 in this manner in the state in which the movement member 4 is position-determined in the standing position, the latching member 3 operates and the elastic force of the first arm portion 20 of the contact point member 2 may automatically rotate the movement member 4 to be positioned in the horizontal position. Therefore, a user may easily determine whether or not the electrical connection between the conductive layer of the substrate 15 and the contact point member 2 is made, by checking the position in which the movement member 4 has rotated.

Second Embodiment

Figure 11:
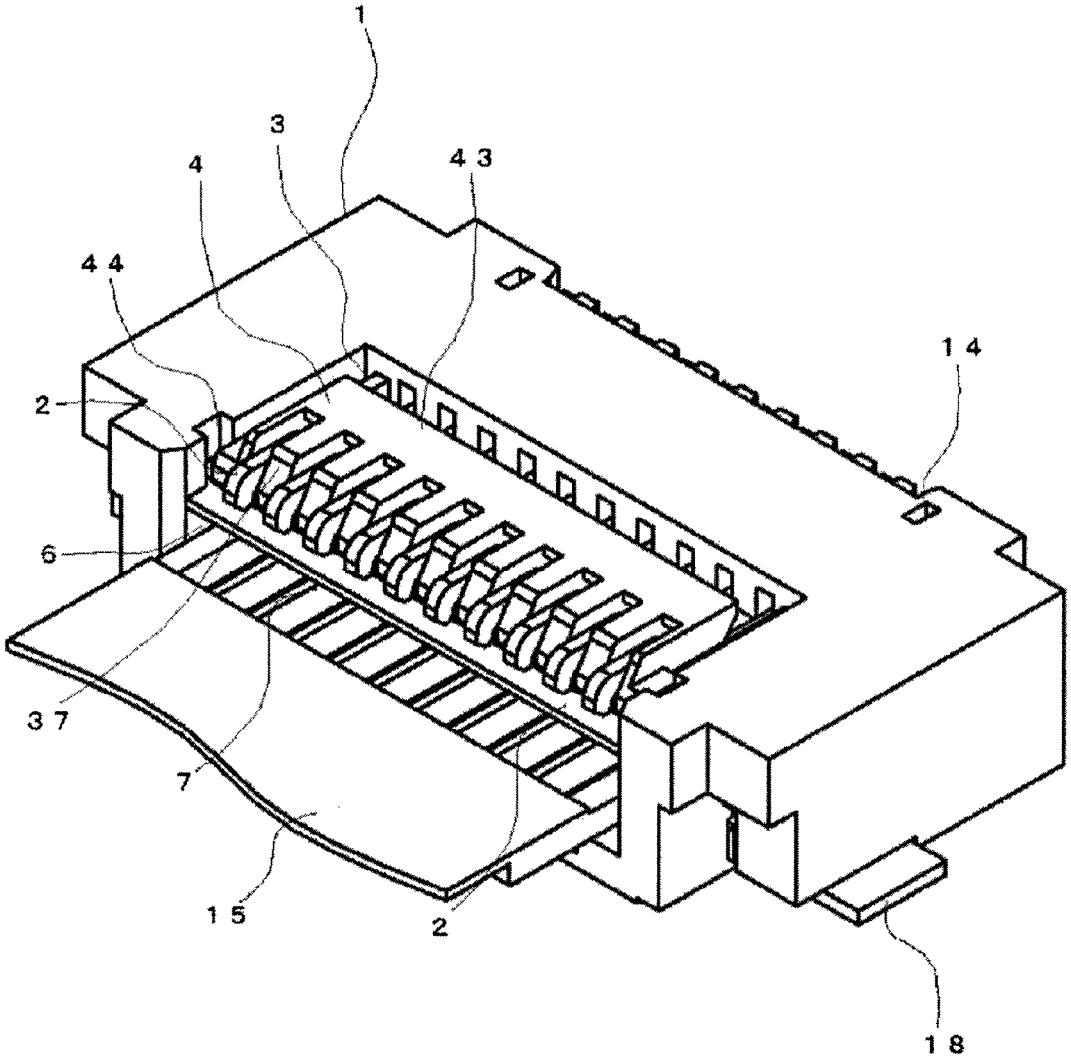
FIG. 11 is a perspective view illustrating a state in which the substrate is installed in a connector according to a second embodiment.

FIG. 11 illustrates a connector according to a second embodiment. Because this connector is different from that of the first embodiment only in terms of one part of the constructions of a housing 1 and a movement member 4, and is almost the same in terms of the other configurations, a description of same construction is not repeated.

As illustrated in FIG. 11, the housing 1 has groove portions 44 extending upward and downward, which are formed in the front sides of both lateral surfaces which make up a recess 5.

Figure 12A:
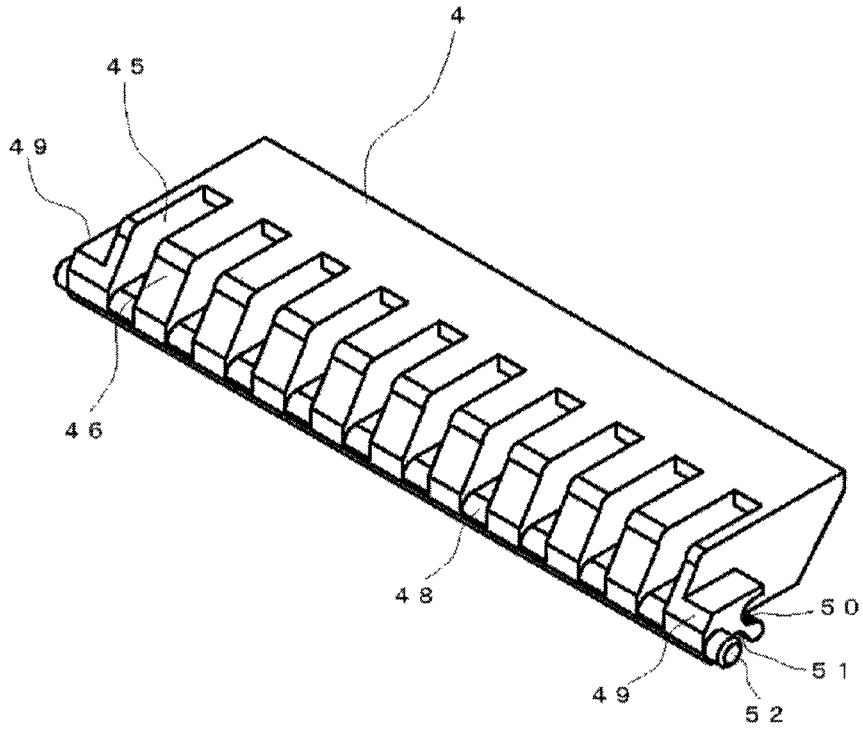
FIG. 12A is a perspective view illustrating a movement member in FIG. 11.
Figure 12B:
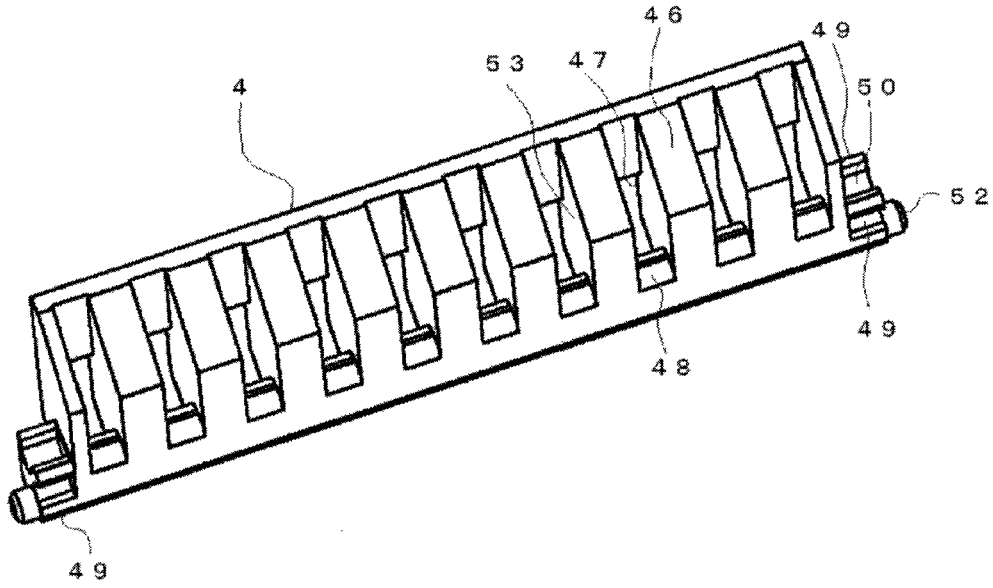
FIG. 12B is a perspective view illustrating a state of the movement member in FIG. 12A when viewed from a different angle.

As illustrated FIGS. 12A to 12B, a plurality of guide walls 46 are formed in the upper surface half part of the movement member 4. The plurality of guide walls 46 are configured from a plurality of first groove portions 45 that are provided at predetermined intervals in the longitudinal direction. Furthermore, a shaft portion 48 is formed between the guide walls 46, by a communication hole 47 that is provided in the bottom surface of the first groove portions 45 to communicate upward and downward. A protrusion portion 49 is formed to protrude from each of both of the end surfaces of a shaft portion 39. A first latch recessed portion 50 and a second latch recessed portion 51 are formed in an edge portion of each of the protrusion portion 49. Furthermore, a guide shaft 52 protrudes from the end surface of each of the protrusion portions 49. The guide shaft 52 is arranged in a groove portion 36 of the housing 1. A second groove portion 53 corresponding to the first groove portion 45 is formed in the lower surface half part (the opposite side of a groove portion 17) of the movement member 4. Each arm portion 31 of the latching member 3 is inserted via the groove portions 17 that are positioned in both sides, and the latch protrusion portion 35 that is provided in the leading end thereof is unlatched in each latch recessed portion. Furthermore, a holding portion of a contact point member 2 is inserted via the second groove portions 53 so that each shaft portion 48 is held.

In the connector with this configuration, the movement member 4 is positioned inside the first groove portion 45, and there is no part that juts out from the housing 1. Therefore, the connector is made compact, and may not be damaged even though an external force is exerted on the movement member 4 while the connector is being in transit.

In the case where the substrate 15 is inserted into the insertion recessed portion 6 of the housing 1, an operation unit 43 of the movement member 4 is held and lifted up. At this time, the latch protrusion portion 35, which is provided in the leading end of the arm portion 31 of the latching member 3, is unlatched from the second latch recessed portion 51, and is latched into the first latch recessed portion 50. For this reason, the movement member 4 is maintained in a standing position, the arm portion 31 of the contact point member 2 is elastically deformed, and the contact point portion 25 is retracted from the insertion recessed portion 6.

When the substrate 15 is inserted into the insertion recessed portion 6 of the housing 1, a pressure receiving portion of the latching member 3 is pushed inwards against an urging force of an elastic portion 33, and the latch protrusion portion 35 provided in the leading end of the arm portion 31 is unlatched from the first latch recessed portion 50. As a result, the movement member 4 can perform a free rotational movement, and thus rotates in the direction in which the substrate 15 is inserted with respect to the shaft portion 48, that is, rotates to roll into the first groove portion 45 of the housing 1, because the elastic force of the arm portion 31 of the contact point member 2 acts on it. Furthermore, the contact point portion 25 of the contact point member 2 protrudes into the insertion recessed portion 6 and thus comes into pressure contact with a conductive portion 15*a* of the substrate 15.

Third Embodiment

Figure 13:
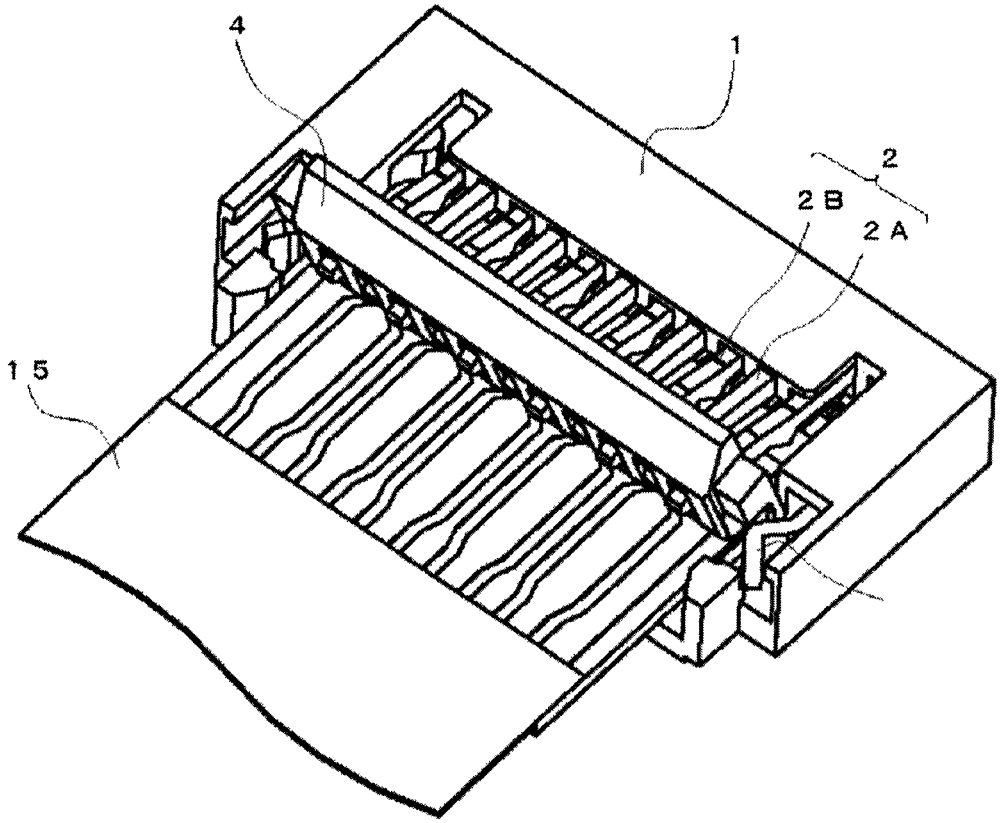
FIG. 13 is a perspective view illustrating a connector according to a third embodiment and a substrate.

FIG. 13 illustrates a connector according to a third embodiment. Because this connector is different from that of the first embodiment in terms of the configurations of one part of a contact point member 2 and one part of a movement member 4 and in terms of the configurations of a housing 1 and a latching member 3, but is almost the same in terms of the other configurations, a description of what has not any different construction is not repeated.

Figure 14:
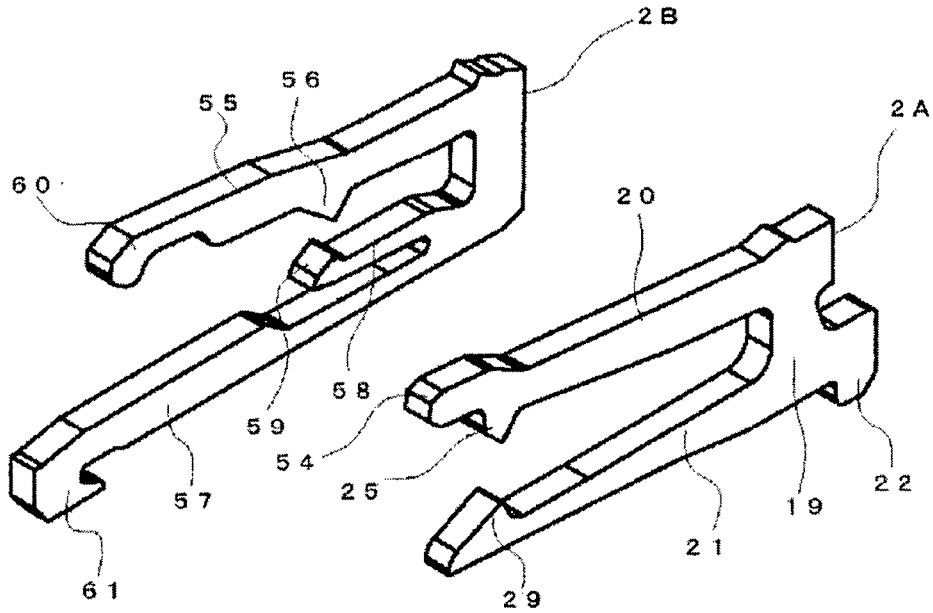
FIG. 14 is a perspective view of a contact point member in FIG. 13.

The contact point member 2 includes a first contact point member 2A and a second contact point member 2B. The first contact point member 2A having almost the same construction as those of the embodiments described above and the second contact point member 2B having a different construction from those of the embodiments described above are alternately arranged in the arrangement direction. As illustrated in FIG. 14, the first contact point member 2A has the straight shape in which a holding piece 54 at the leading end only protrudes in a simple manner. Furthermore, in the second contact point member 2B, a contact point portion 56 is formed in a base portion of a first arm portion 55, and a protrusion portion 59 is formed in the leading end of a third arm portion 58 that diverges from a second arm portion 57. A holding piece 60, which is shaped approximately like a letter C as in the embodiments described above, is formed in the leading end side of the first arm portion 55. The leading end side of the second arm portion 57 serves as a terminal portion 61 that is formed in the shape of a hook which curves downward.

Figure 15A:
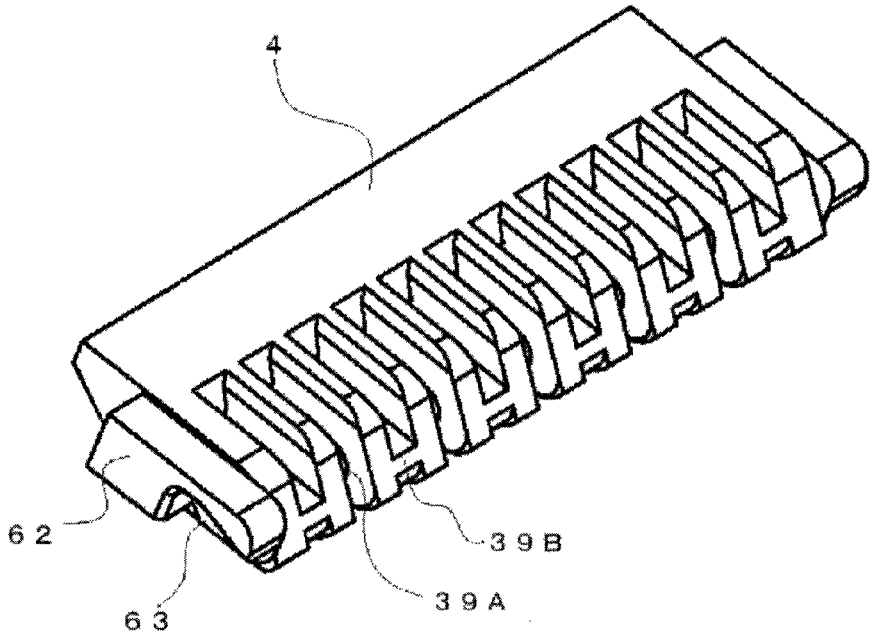
FIG. 15A is a perspective view illustrating the movement member in FIG. 13.
Figure 15B:
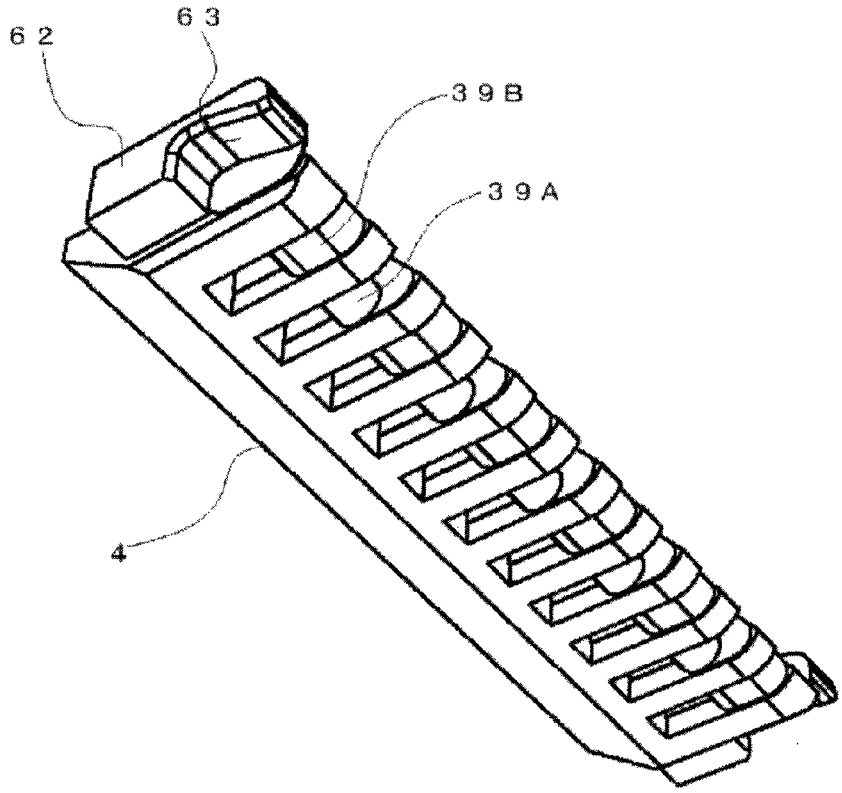
FIG. 15B is a perspective view illustrating a state of the movement member in FIG. 15A when viewed from a different angle.

As illustrated in FIGS. 15A and 15B, in the movement member 4, the shaft portion 39 is configured to include a first shaft portion 39A and a second shaft portion 39B. The first shaft portion 39A is cylindrical-shaped, with which the holding piece of the first contact point member 2A comes into contact. The second shaft portion 39B has the same shape as in the embodiments described above, and is held in the holding piece 60 of the second contact point member 2B. Furthermore, a latch receiving portion 62 is formed in each of both end parts of the movement member 4. Each of the latch receiving portions 62 has a latch recessed portion 63 formed in the bottom thereof.

Figure 16A:
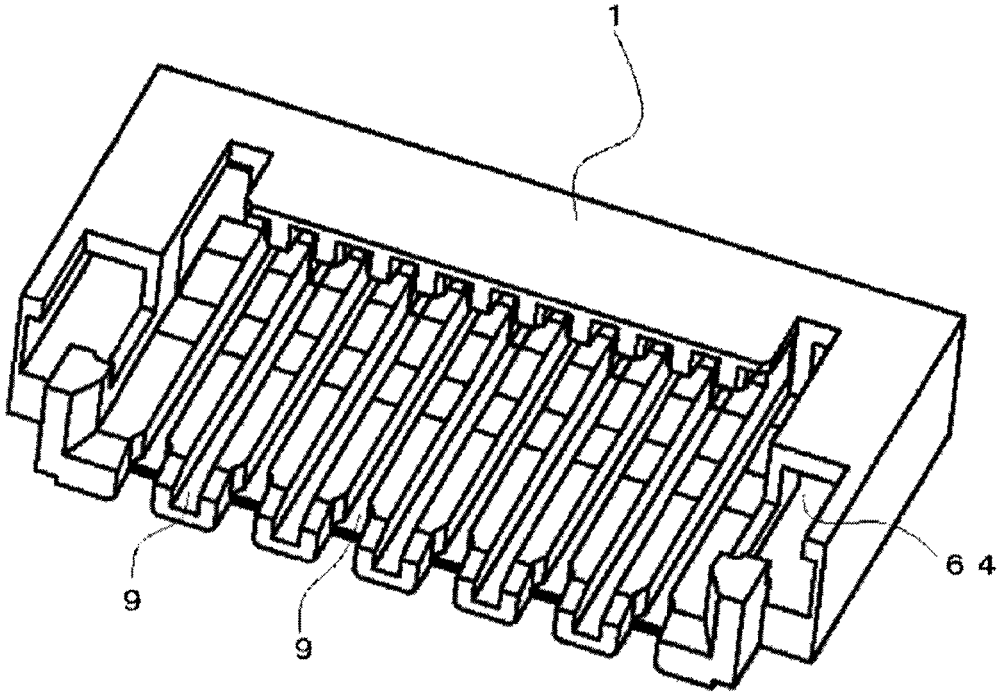
FIG. 16A is a perspective view illustrating a housing in FIG. 13.
Figure 16B:
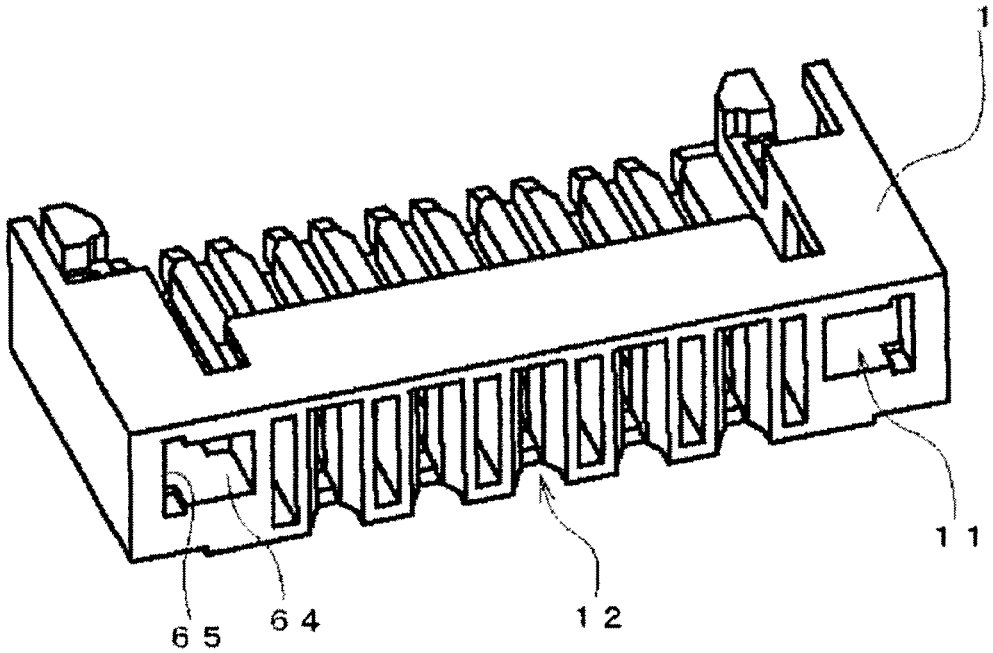
FIG. 16B is a perspective view illustrating a state of the housing in FIG. 16A when viewed from a different angle.

As illustrated in FIGS. 16A and 16B, in the housing 1, an accommodation room 64 is formed in each of both end parts. The accommodation room 64 has a cross section, which has an approximately rectangular shape, and extends forward and backward. The accommodation room 64 is open at the rear end of the housing 1 (rear end opening), and has an abutting receiving portion 65, which protrudes inwards, is formed in one surface (an outer side surface) of the internal surfaces thereof.

Furthermore, the accommodation room 64 is open at an upper part near the front side of the housing 1 (front end opening) and is also open in the inner side lateral wall.

Figure 17:
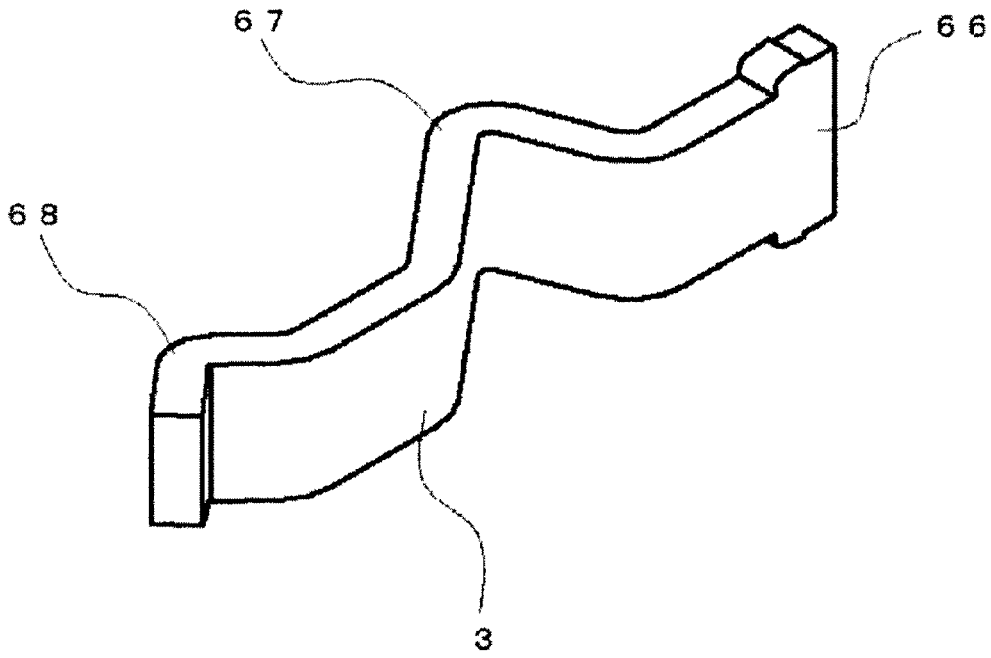
FIG. 17 is a perspective view illustrating a latching member in FIG. 13.

As illustrated in FIG. 17, the latching member 3 is made by bending a plate member made of elastic material, and includes an abutting portion 66 in the rear end, a pressure receiving portion 67 protruding inwards and sideways in the shape of a chevron in succession to the abutting portion 66, and a latching portion 68 protruding inwards and sideways in the shape of a chevron in the front end part. The latching member 3 is inserted into the accommodation room 64 in the housing 1 from the rear end opening. In an insertion condition, the abutting portion 66 of the latching member 3 comes into contact with the abutting receiving portion 65 formed in the accommodation room 64 of the housing 1, and the latching portion 68 is exposed from the front end opening.

According to the connector described above, before inserting the substrate 15 into the housing 1, the movement member 4 is rotated to a standing position where the movement member 4 protrudes from the housing 1. At this time, the latching portion 68 of the latching member 3 is latched onto the latch recessed portion 63 of the movement member 4 in the sideways direction, and the movement member 4 is maintained in the standing position.

Furthermore, a contact point portion 25 of the contact point member 2 is retracted from an insertion recessed portion 6. For this reason, the insertion of the substrate 15 into the insertion recessed portion 6 may be smoothly performed without receiving any resistance.

When the substrate 15 is inserted into the insertion recessed portion 6, a leading end corner portion thereof comes into contact with a pressure receiving portion 67 of the latching member 3. When the substrate 15 is pushed more inwards, the latching member 3 is elastically deformed and the latching portion 68 moves sideways. The latching portion 68 is separated from a latch recessed portion 63 of the movement member 4, and the movement member 4 has a free rotational movement. As a result, the movement member 4 rotates to a horizontal position by an urging force of the contact point member 2, and the substrate 15 is interposed between the contact point portion 25 and the protrusion portion 28. The contact point portion 25 comes into pressure contact with a conductive portion 15*a* of the substrate 15, so that the electrical connection is made.

In this manner, the substrate 15 may be interposed between the contact point portion 25 and the protrusion portion 28 of the contact point member 2 only by inserting the substrate 15 into the insertion recessed portion 6 of the housing 1. A rotational position of the movement member 4 and a movement position of the latching portion 68 of the latching member 3 may be visually recognized, and the installation of the substrate 15 in the proper position may be recognized from the outside of the housing 1.

Fourth Embodiment

Figure 18:
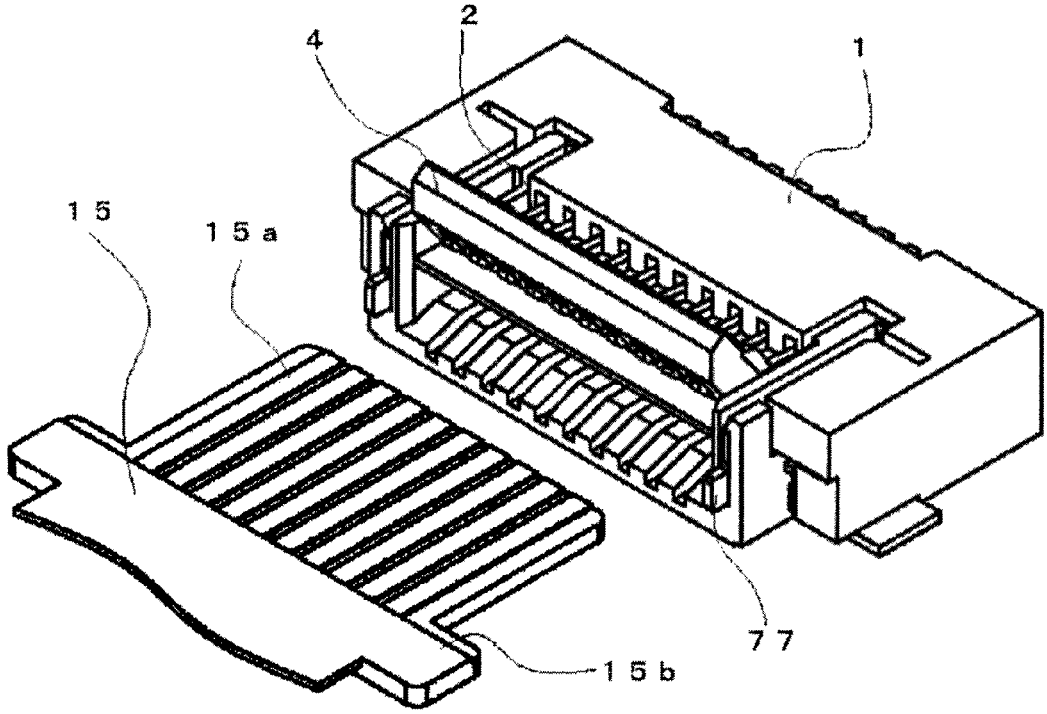
FIG. 18 is a perspective view illustrating a connector according to a fourth embodiment and a substrate.

FIG. 18 illustrates a connector according to a fourth embodiment. Because this connector is different from that of the first embodiment only in terms of one part of a housing 1 and one part of a substrate 15 and in terms of a configuration of a latching member 3, and is almost the same in terms of the other configurations, a description of same construction is not repeated.

Figure 19A:
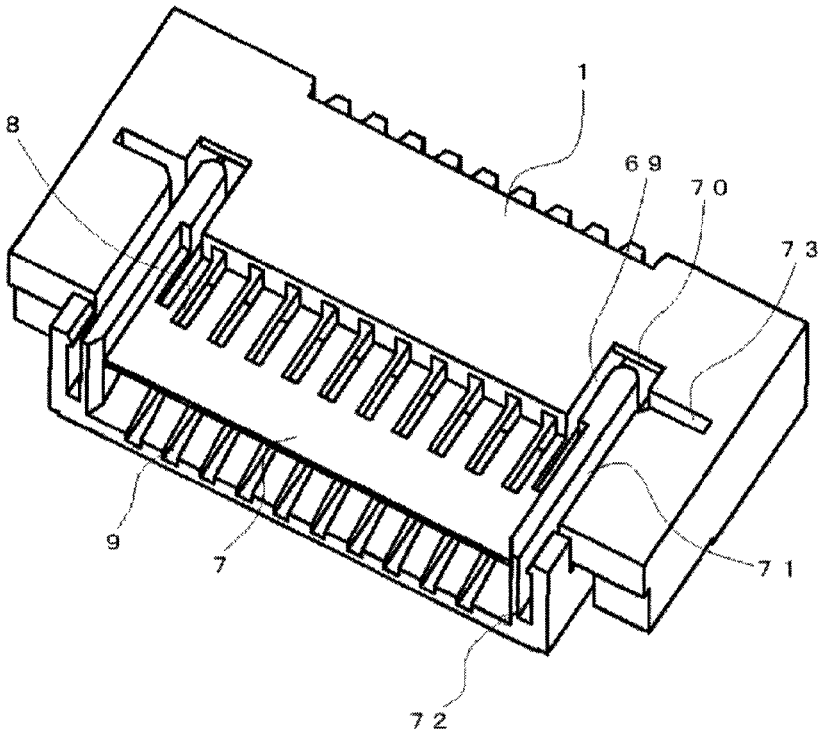
FIG. 19A is a perspective view illustrating the housing in FIG. 19.
Figure 19B:
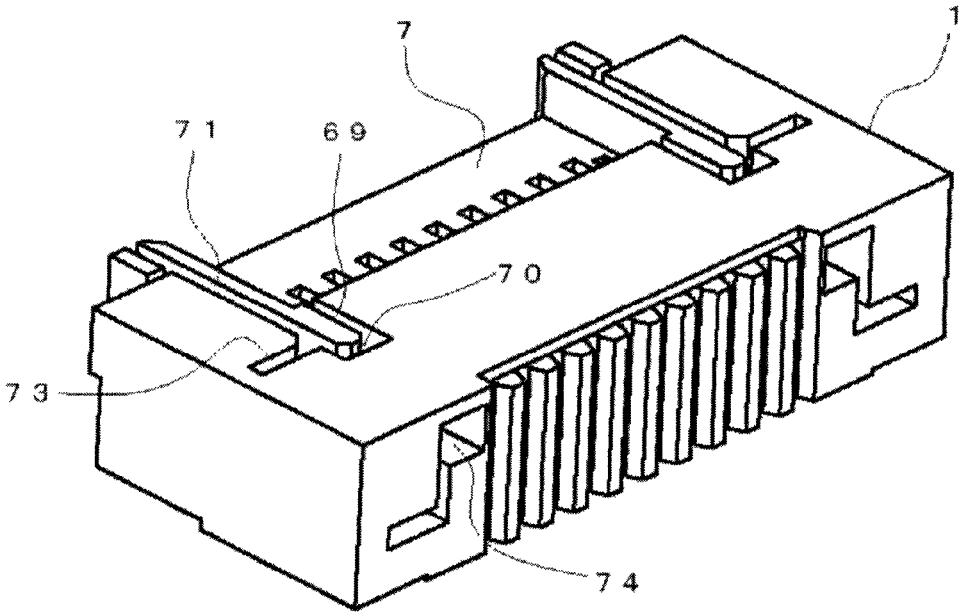
FIG. 19B is a perspective view illustrating a state of the housing in FIG. 19A when viewed from a different angle.

As illustrated in FIGS. 19A and 19B, a housing 1 has guide groove portions 72 at both end portions thereof. Each of the guide groove portions 72 is made from an inside groove 69 extending backward from the rear surface of a recess 5, a successive groove 70 that is bent sideways, and an outside groove 71 that is bent forward from the successive groove 70 and of which the sideways position extends more forward. A complementary groove 73 is formed to extend further sideways from the rear side of the outside groove 71.

A communication passage 74 extends in a manner to be continuous from the rear end of the outside groove 71 and the part, exclusive of the upper end, of the successive groove 70 to the rear surface of the housing 1.

Press pieces 15*b* are formed in a substrate 15. The press pieces 15*b* protrude sideways from both lateral parts, respectively. The protrusion position of the press piece 15*b* is a terminal end part of a conductive portion 15*a* that extends from a leading end.

Figure 20:
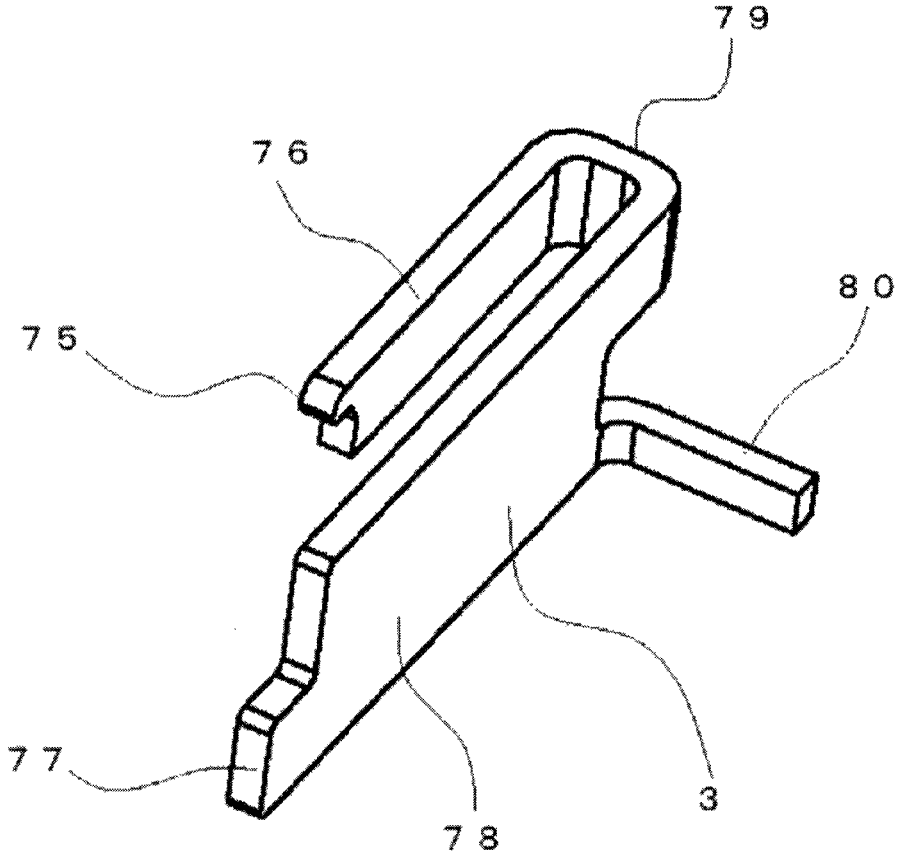
FIG. 20 is a perspective view illustrating a latching member in FIG. 19.

As illustrated in FIG. 20, a latching member 3 is made by shaping a plate-like body into a body with the shape of a letter approximately like U. The latching member 3 is configured from an arm portion 76 having a latch protrusion portion 75 in the leading end, a slide portion 78 that is wider in the upward and downward directions than the arm portion 76 and in which an abutting receiving portion 77 is formed in a lower part of the leading end, a connection portion 79 that connects the arm portion 76 and the slide portion 78 to each other, and an elastic portion 80 that extends sideways from the slide portion 78. In the arm portion 76, a base portion side is arranged in the inside groove 69 of the housing 1. The latch protrusion portion 75 may be latched/unlatched onto each of latch recessed portions 41 and 42 of a movement member 4. The connection portion 79 is arranged in the successive groove 70 of the housing 1. The slide portion 78 is arranged in the outside groove 71 in the housing 1, and causes the abutting receiving portion 77 to protrude from the front end surface of the housing 1. The elastic portion 80 is arranged in the complementary groove 73 of the housing 1. The latching member 3 is configured to be movable from in the state of being arranged inside the guide groove portion 72 to in the state of being position in the communication passage 74 on the rear side.

According to the connector with the configuration described above, when the substrate 15 is inserted into an insertion recessed portion 6, the press pieces 15*b* formed in the substrate 15 come into contact with the abutting receiving portion 77 that protrudes from the front surface of the housing 1. When the substrate 15 is further pushed inwards, the abutting receiving portion 77 is pushed inwards, thus the latching member 3 moves backward while elastically deforming the elastic portion 80 and the latch protrusion portion 75 is unlatched from a first latch recessed portion 41 of the movement member 4. Accordingly, the movement member 4 moves from a standing position to a horizontal position by an urging force of a first arm portion 20 of a contact point member 2. Therefore, the user may visually be aware from the outside of the housing 1 that the substrate 15 is inserted to a proper position and thus an electrical connection between a conductive portion 15*a* of the substrate 15 and a contact point portion 25 of the contact point member 2 is made, based on the rotational movement of the movement member 4.

Furthermore, the present invention is not limited to the configurations of the embodiments described above, and various modifications thereto are possible.

For example, in the embodiments described above, from the rotational position of the movement member 4, it may be determined whether or not the electrical connection between the substrate 15 and the contact point member 2 is made, but the configuration, in which sound is outputted when the movement member 4 rotates, may be further adopted. Movement sound due to friction is generated when the latch protrusion portion 35 formed in the arm portion 31 of the latching member 3 is unlatched from a second latch recessed portion 42 of the latching member 3, but furthermore research may be intensively done to come up with a method of separately providing a laminated protrusion so as to make the generated movement sound greater.

There has thus been shown and described a connector which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A connector comprising:

a housing that includes an insertion recessed portion for receiving a substrate inserted into the insertion recessed portion;

a contact point member that includes a contact point portion, the contact point portion for being connected electrically to a conductive portion of the substrate when inserted into the insertion recessed portion, the contact point member being installed in the housing, the contact point portion extending into the insertion recessed portion; and a position determining member including a latching member and a movement member that operate to determine a position of the contact point member, and selectively causes the contact point portion to i) contact the conductive portion of the substrate if said substrate is inserted, and ii) retract the contact point portion from the insertion recessed portion, wherein the movement member is movable between a first position where the contact point portion of the contact point member is retracted from the insertion recessed portion, and a second position where the contact point portion of the contact point member protrudes into the insertion recessed portion, and the latching member is able to position-determine the movement member at the first position and cancels the position-determined state by being moved by the substrate being inserted into the insertion recessed portion in the housing.

2. The connector according to claim 1, wherein the position determining member is moveable, wherein movement of the position determining member is recognizable from outside of the housing.

3. The connector according to claim 1, wherein the first position of the movement member is a position where the movement member protrudes from the housing and is distinguishable from the second position.

4. The connector according to claim 1, wherein the movement member includes a shaft portion, and wherein the contact point member includes a holding portion that elastically holds the shaft portion of the movement member in a state of being installed in the housing.

5. The connector according to claim 4, wherein the holding portion of the contact point member urges the movement member positioned in the first position in such a manner that the movement member is movable to the second position.

6. The connector according to claim 1, wherein the movement member is supported by the holding portion of the contact point member in such a manner as to rotate about the shaft portion, and the movement of the movement member from the first position to the second position is caused by the rotation about the shaft portion.

7. The connector according to claim 1, wherein the latching member includes a pressure receiving portion that is pressed by a leading end edge of the substrate inserted into the insertion recessed portion in the housing, an elastic member that is elastically deformed by the pressure receiving portion being pressed, and an arm portion that is separated from the movement member by the elastic member being elastically deformed, and wherein the movement member includes a first latch recessed portion onto which a latch protrusion portion formed in the arm portion is able to be latched when the movement member is in the first position, and a second latch recessed portion onto which the latch protrusion portion formed in the arm portion is able to be latched when the movement member is in the second position.

8. The connector according to claim 1, wherein the position determining member includes a movement sound generating mechanism that generates movement sound when the position determining member is moved by the substrate being inserted into the insertion recessed portion in the housing so that the position-determined state is canceled.

* * * * *